US005925313A

United States Patent [19]

Kajihara et al.

[11] Patent Number: 5,925,313

[45] Date of Patent: Jul. 20, 1999

[54] ALUMINUM BASE ALLOY CONTAINING BORON AND MANUFACTURING METHOD THEREOF

[75] Inventors: Katsura Kajihara, Kobe; Haruo Kakunai, Takasago; Yuichi Seki, Kobe; Tadahiko Yamashita, Takasago; Masahiro Yanagawa, Kobe, all of Japan

[73] Assignee: Kabushiki Kaisha Kobe Seiko Sho, Kobe, Japan

[21] Appl. No.: 08/635,779

[22] Filed: Apr. 22, 1996

[30] Foreign Application Priority Data

| | | | |
|---|---|---|---|
| May 1, 1995 | [JP] | Japan | 7-107572 |
| Oct. 13, 1995 | [JP] | Japan | 7-265655 |
| Jan. 31, 1996 | [JP] | Japan | 8-015800 |

[51] Int. Cl.[6] ..... C22C 21/00

[52] U.S. Cl. ..... 420/528; 420/533; 420/534; 420/535; 420/541; 420/542; 420/543; 420/544; 148/439; 148/440; 376/287

[58] Field of Search ..... 420/533, 534, 420/535, 541, 542, 543, 544; 148/439, 440; 376/287

[56] References Cited

U.S. PATENT DOCUMENTS

| | | | |
|---|---|---|---|
| 4,595,559 | 6/1986 | Planchamp | 148/439 |
| 4,806,307 | 2/1989 | Hirose et al. | 420/542 |

FOREIGN PATENT DOCUMENTS

| | | |
|---|---|---|
| 0 255 484 | 2/1988 | European Pat. Off. . |
| 2 533 943 | 4/1984 | France . |
| 43 08 612 | 9/1994 | Germany . |
| 61-235523 | 10/1986 | Japan . |
| 62-12895 | 1/1987 | Japan . |
| 62-1834 | 1/1987 | Japan . |
| 62-99445 | 5/1987 | Japan . |
| 62-177141 | 8/1987 | Japan . |
| 62-243733 | 10/1987 | Japan . |
| 63-38553 | 2/1988 | Japan . |

OTHER PUBLICATIONS

Patent Abstracts of Japan, vol. 14, No. 109 (C–0695), Feb. 28, 1990, JP–A–01 312044, Dec. 15, 1989.

Database WPI, Derwent Publications, AN–82–51656, JP–B–57 025159, May 27, 1982.

Database WPI, Derwent Publications, AN–78–47003, JP–A–53 057399, May 24, 1978.

Patent Abstracts of Japan, vol. 17, No. 176 (C–1045), Apr. 6, 1993, JP–A–04 333542, Nov. 20, 1992.

Patent Abstracts of Japan, vol. 14, No. 109 (C–0695), Feb. 28, 1990, JP–A–01 312043, Dec. 15, 1989.

Database WPI, Derwent Publications, AN–82–56095, JP–A–57 086783, May 29, 1982.

Database WPI, Derwent Publications, AN–91–027134, JP–A–2 298894, Dec. 11, 1990.

Patent Abstracts of Japan, vol. 13, No. 156 (C–585), Apr. 14, 1989, JP–A–63 312943, Dec. 21, 1988.

*Primary Examiner*—David A. Simmons
*Assistant Examiner*—M. Alexandra Elve
*Attorney, Agent, or Firm*—Oblon, Spivak, McClelland, Maier & Neustadt, P.C.

[57] ABSTRACT

There is provided an Al base alloy containing boron which is superior in mechanical properties such as strength, ductility or workability and the like and has a neutron absorbing capacity and an ability to recycle. This is an Al base alloy containing boron with Mg: 2 to 8% (massed %, similarly applied hereinafter) and B: 0.5 to 1.5% and satisfying a relation of $^{10}B/(^{10}B+^{11}B)\geqq 95\%$, and a rate of $AlB_2$ in all boron compounds is 80% or more by a volumetric rate.

15 Claims, 12 Drawing Sheets

ALUMINUM BASE ALLOY CONTAINING BORON AND MANUFACTURING METHOD THEREOF

BACKGROUND OF THE INVENTION

1. Field of the Invention

This invention relates to an aluminum base alloy containing boron having a neutron absorbing capacity which is effective for a structural material for a transporting packaging (cask) for transporting spent nuclear fuel or a storage cask container and the like, and its manufacturing method.

2. Description of the Related Art

As the structural material having a neutron absorbing capacity, alloy added with boron within aluminum alloy is used. In order to manufacture such an alloy as described above, boron in the form of powder is normally added in molten pool of Al, (Al-bath) or boron in the form of boronfluoride such as $KBF_4$ is added in Al-bath so as to generate intermetallic compound, although various kinds of improvements have been applied in order to increase mechanical properties such as strength or ductility.

For example, in the gazette of Japanese Patent Laid-Open No. Hei 1-312044 is disclosed a method in which boron is added in the form of powder of 12 aluminum boride ($AlB_{12}$) or in the form of Al—B mother alloy mainly containing at least $AlB_{12}$ so as to restrict a reaction between B and Mg and then its strength is reduced on the basis of production of these intermetallic compounds. In addition, in the gazette of Japanese Patent Laid-Open No.Hei 1-312043 is disclosed a method in which a melting processing is carried out in a high temperature region of 1200° C. or more in order to restrict a reaction between B and Mg. Further, in the gazette of Japanese Patent Laid-Open No.Hei 4-333542 is disclosed a method for getting Al—B alloy having a low viscosity and having a superior castability by reacting $KBF_4$ with Al within a temperature range of about 680 to 850° C. and adding a small amount of $K_2TiF_6$ in the melts of Al—B alloy containing the generated $AlB_2$ crystal in order to eliminate a high viscosity of the melts and improve a forming and workability.

However, all these alloys manufactured by these methods show a problem that once they are solidified, they may not be utilized again. That is, when the scrap alloy is melted again, an intermetallic compound $AlB_{12}$ which is quite stable and fragile is enevitably produced, so that there is a problem in view of recycling of it as the structural material. Although it is necessary to apply hot-rolling or extrusion of the scrap alloy in order to reproduce it as the structural material, an existence of $AlB_{12}$ within an entire boron compound with a volumetric rate of 20% or more causes its working to be quite difficult and this fact becomes a cause for recycling of the scrap alloy difficult.

The alloy described in the gazette of Japanese Patent Laid-Open No.Hei 4-333542 in the aforesaid methods is an Al—B alloy in which it contains 0.001 to 0.05 wt % of Ti and an entire boron is composed of $AlB_2$ crystals, although this alloy does not contain Mg, Si and the like, so that this alloy has disadvantages that it is inferior in its mechanical properties such as strength or the like, its remelting causes $AlB_{12}$ to be enevitably produced and then the scrap alloy may not be utilized again.

In addition, all the aforesaid methods apply natural boron. Originally, boron has a isotope composition composed of $^{10}B$ (about 20%) and $^{11}B$ (about 80%), and boron having a superior neutron absorbing capacity is mainly $^{10}B$. Due to this fact, in order to get a desired neutron absorbing capacity, it is actually necessary to use a large amount of expensive boron and so it is accompanied with a problem of increasing a manufacturing cost.

SUMMARY OF THE INVENTION

The present invention has been completed in view of the aforesaid situations, and it is an object of the present invention to provide an Al base alloy containing boron having a neutron absorbing capacity in which a manufacturing cost can be reduced, recycling of the scrap can be carried out and it has superior mechanical properties such as strength or ductility, and its manufacturing method.

The Al base alloy of the present invention capable of resolving the aforesaid problems has its gist in which it contains B: 0.5 to 1.5% (mass %, hereinafter similarly applied), balance: Al and enevitable impurities, satisfying a relation of $^{10}B/(^{10}B+^{11}B)\geqq 95\%$ and a rate of $AlB_2$ in entire boron compound is 80% or more in a volumetric rate.

More practically, the Al base alloy containing boron of the present invention includes the following component system-snnn:

(1) Al—Mg type alloy containing boron to include additionally Mg: 2 to 8%

(2) Al—Mg—Si type alloy containing boron to include additionally Mg: 0.3 to 1.5% and Si: 0.3 to 1.5%

(3) Al—Mg—Zn type alloy containing boron to include additionally Mg: 1.0 to 4.0% and Zn: 0.8 to 8.0%

(4) Al—Cu type alloy containing boron to include additionally Cu: 1.5 to 7.0%

(5) Al—Mn type alloy containing boron to include additionally Mn: 0.3 to 2.0%

In each of these alloys (1) to (5), each of the following selective allowable elements (each of these elements does not include 0%) can be positively added.

(6) Al—Mg type alloy or Al—Mg—Si type alloy containing boron to include at least one element selected from a group composed of Cu: 0.6% or less, Mn: 1.0% or less, Cr: 0.4% or less, Zr: 0.3% or less, Zn: 0.5% or less and Ti: 0.3% or less in the aforesaid alloy (1) and (2)

(7) Al—Zn—Mg type alloy containing boron to include at least one element selected from a group further composed of Cu: 3.0% or less, Mn: 1.0% or less, Cr: 0.4% or less, Zr: 0.3% or less, Ti: 0.3% or less in the aforesaid alloy of (3)

(8) Al—Cu type alloy containing boron to include at least one element selected from a group further composed of Mg: 1.8% or less, Mn: 1.2% or less, Cr: 0.4% or less, Zr: 0.3% or less, Zn: 0.5% or less, Ti: 0.3% or less in the aforesaid alloy of (4)

(9) Al—Mn type alloy containing boron to include at least one element selected from a group further composed of Mg: 1.8% or less, Cu: 0.6% or less, Cr: 0.4% or less, Zr: 0.3% or less, Zn: 0.5% or less, Ti: 0.3% or less in the aforesaid alloy of (5)

In addition, the alloy having Fe: 2.0% or less (including 0%) in the aforesaid Al—Mg—Si type alloy and the alloy having Fe: 2.0% or less (including 0%) and Si: 1.5% or less (including 0%) in other alloys except the aforesaid Al—Mg—Si type alloy are the preferable embodiment of the present invention.

In addition, an alloy in these alloys having a residual hydrogen concentration restricted to 0.6 ppm or less (including 0 ppm) in order to obtain an alloy having a superior surface state of less surface bulging is a preferred embodiment of the present invention.

The method for manufacturing Al base alloy containing boron of the present invention satisfying such requirements as above has its gist in an operation in which condensed boron: 0.5 to 1.5% with an amount of inclusion of isotope element $^{10}B$ of 95% or more is applied to form blocks at a melting temperature: 900° C. or more to 1200° C. or lower. In this case, a casting of alloy under a condition in which a cooling rate during casting operation is increased up to 0.1° C./sec or more and a pressure is controlled to a value of 500 Torr or less is the preferred embodiment of the present invention.

BEST MODE FOR CARRYING OUT THE INVENTION

Inventors of the present invention have repeated a study by paying a special attention to a melting temperature during melting in order to provide an Al base alloy containing boron capable of performing recycling of scrap and having superior mechanical properties such as strength or machining characteristics and to provide its manufacturing method. As a well-known method for controlling a melting temperature, the method described in the aforesaid gazette of Japanese Patent Laid-Open No.Hei 1-312043 can be attained, although in accordance with this method, the melting temperature is increased from the prior art low temperature range of 700 to 800° C. once up to 1200° C. (preferably 1200 to 1500° C.) in order to restrict a reaction between B and Mg and to increase a strength of the alloy. However, it has been found that when melting is carried out in such a high temperature range as above, it is difficult to cause Mg to be evaporated and to assure a mechanical properties such as a strength.

In view of these facts, the present inventors have further studied to eliminate such disadvantages as above and found that it is satisfactory that a melting temperature where the reaction between B and Mg can be restricted is 900° C. or more to 1200° C. or lower, and if the melting is carried out in such a temperature range as above, it is possible to avoid reduction in mechanical characteristic caused by the aforesaid evaporation of Mg, and it is also possible to obtain the Al base alloy containing boron capable of performing recycling of scrap and having a superior mechanical properties which is the most-important target in the present invention. Further, the prior art method was carried out in such a way that a block forming condition was not specifically controlled but the block was formed with a cooling rate to a solidification during casting operation being set to 0.1° C./sec under a normal atmosphere (1 atm, 760 Torr). However, the present inventors have found that the cooling rate or the pressure may provide a substantial contribution for accomplishing the aforesaid objects, and completed the present invention totally in reference to these facts.

At first, the Al base alloy containing boron of the present invention will be described.

The Al base alloy containing boron of the present invention is represented more practically by (1) Al—Mg type alloy, (2) Al—Mg—Si type alloy, (3) Al—Zn—Mg type alloy, (4) Al—Cu alloy and (5) Al—Mn alloy and the like to be described later and in any case it is necessary that it contains boron by 0.5 to 1.5% and this boron satisfies a relation of $^{10}B/(^{10}B+^{11}B)\geqq 95\%$. In this way, the present invention has a first feature in the fact that 0.5 to 1.5 wt % of B satisfying a relation of $^{10}B/(^{10}B+^{11}B)\geqq 95\%$ is contained in the Al base alloy containing boron. As described above, boron has an isotope configuration comprised of $^{10}B$ (about 20%) and $^{11}B$ (about 80%). However, the element having a superior neutron absorbing capacity is $^{10}B$ and it is satisfactory if $^{10}B$ of 95% or more is present in the alloy in order to perform an effective realization of the neutron absorbing capacity by adding boron. Although the element satisfying such conditions as above will be described in detail in reference to the manufacturing method to be described later, it is recommended that condensed boron having an amount of inclusion of the isotope element $^{10}B$, for example, is used as its raw material. If such a condensed boron is used, its amount of application can be reduced as compared with that of the prior art application of natural boron as its raw material and concurrently this condensed boron is one in which only $^{10}B$ having a neutron absorbing capacity is highly condensed, so that its action can be realized more effectively. In this case, in order to perform an effective realization of neutron absorbing capacity through boron, it is necessary to add boron of 0.5% or more. Preferably, the value is 0.6% or more, and more preferably the value is 0.7% or more. In turn, even if boron exceeding 1.5% is added, its effect merely consists in its saturation and this is not only economically useless, but also generates a disadvantage that a large amount of $AlB_{12}$ badly influencing against utilization in recycling or working processing and the like is produced. Preferably, the value is 1.3% or less and more preferably the value is 1.2% or less.

As to the included elements other than the aforesaid B, they will be separately described for every alloys.

(1) Al—Mg type alloy

Mg: 2 to 8%

Mg is an element having an action of solid-solution hardening and an action to work hardening so as to increase a strength. In order to make an effective realization of such actions as above, it is necessary to add 2% or more and a value of 2% or lower shows a lack of strength. A preferable lower limitation value is 3% and a more preferable value is 4%. In turn, adding of the value exceeding 8% causes ductility to be decreased, edge cracks or surface cracks to be generated, resulting in that a working process such as a rolling operation becomes difficult. A preferable upper limitation value is 7% and a more preferable value is 6%.

(2) Al—Mg—Si type alloy

Mg: 0.3 to 1.5% and Si: 0.3 to 1.5%

Mg and Si form $Mg_2Si$ and contribute to hardening. In order to make an effective realization of such actions as above, it is necessary to add each of elements by 0.3% or more and the elements by 0.3% or lower may cause a lack of strength to be attained. A preferable lower limit value is Mg: 0.4% and Si: 0.4%, and a more preferable value is Mg : 0.5% and Si: 0.5%, respectively. In turn, adding of elements by 1.5% or more causes a coarse compound to be formed and fragile, so that it is necessary to set the value to 1.5% or less. A preferable upper limit value is 1.4% and a more preferable value is 1.3%.

The aforesaid Al—Mg type alloy and Al—Mg—Si type alloy can contain one kind or more than two kinds of the following elements.

Cu: 0.6% or less, Mn: 1.0% or less, Cr: 0.4% or less, Zr: 0.3% or less, Ti: 0.3% or less, Zn: 0.5% or less.

All these elements are elements which contribute to improvement of mechanical properties (strength, ductility, toughness and hardening and the like).

In these elements, Cu is an element which forms $Al_2CuMg$ and contributes to hardening. Since a value exceeding 0.6% causes a coarse $Al_2CuMg$ to be formed and fragile, it is preferable to set its upper limitation value to 0.6%. A more preferable value is 0.5% or less.

Mn, Cr, Zr and Ti are elements for changing crystalline particles into fine particles and for improving strength, ductility and toughness and the like. If the added amount of these elements exceeds the aforesaid ranges, a coarse compound is formed to cause it to be fragile. A more preferable upper limit value is Mn: 0.9%, Cr: 0.3%, Zr: 0.2% and Ti: 0.2%, respectively.

In addition, although Zn is an element contributing to an improvement of strength, if its adding amount exceeds the aforesaid range, a coarse Al—Zn type compound is formed and fragile. A more preferable upper limit value is 0.4% for Al—Mg type compound and 0.3% for an Al—Mg—Si type alloy.

(3) Al—Zn—Mg type alloy

Zn: 0.8 to 8.0% and Mg: 1.0 to 4.0%

Zn and Mg are elements which may contribute to hardening through formation of compounds such as $Mg_3Zn_3Al_2$, $MgZn_2$ and η'-phases of their metastable phases and have an action to improve strength. That is, these compounds may be precipitated by predetermined aging treatment (to be described later), resulting in that they may attain a tensile strength of 450 MPa or more. In order to realize such effects more effectively, it is necessary to add Zn: 0.8% or more and Mg: 1.0% or more and if the values are lower than each of the lower limit values, they may produce a state of lack of strength. The preferable lower limit value is Zn: 0.9% and Mg: 1.1% and more preferable value is Zn: 1.0% and Mg: 1.2%. In turn, if the elements more than Zn: 8.0% and Mg: 4.0% are added, a coarse Al—Zn type compound may be formed and fragile and additionally an ability to resist stress corrosion cracking may also be reduced. The preferable upper limit value is Zn: 7.9%, Mg: 3.9% and the more preferable upper limit value is Zn: 7.8%, Mg: 3.8%, respectively.

The aforesaid Al—Zn—Mg type alloy can contain positively one kind of or two kinds or more of the following elements.

Cu: 3.0% or less, Mn: 1.0% or less, Cr: 0.4% or less, Zr: 0.3% or less, Ti: 0.3% or less.

All these elements are elements which may contribute to the mechanical properties (strength, ductility, toughness and hardening and the like) as described above.

Of these elements, Cu may form compounds such as $Al_2CuMg$ or $Al_2Cu$ and the like and contribute to hardening. If the value of Cu is 3.0% or less, these compounds are in a state of solid solution. However, if the value of Cu exceeds 3.0%, a degree of supersaturation in a high temperature range is increased during an age hardening treatment to be described later and a coarse compound may not be easily formed. A more preferable value is 2.9% or less.

In addition, Mn, Cr, Zr and Ti may change the crystalline particles into fien particles as described above so as to improve strength, ductility and toughness or the like. A more preferable upper limit value is Mn: 0.9%, Cr: 0.3%, Zr: 0.2% and Ti: 0.2%, respectively.

(4) Al—Cu type alloy

Cu: 1.5 to 7.0%

Cu may contribute to a hardening or an increasing in strength through aging precipitation (by aging). That is, Cu in the Al—Cu type alloy may produce $Al_2Cu$ (q phase) in a series of precipitation processes such as α→GP zone →θ' phase →θ phase or a GP zone acting as an intermediate phase or θ' phase and realize an action of hardening or an action to increase strength. In order to realize such actions as above more effectively, it is necessary to add by 1.5% or more and under a value of 1.5% or lower, it may produce a lack of strength. A preferable lower limit value is 1.6% and a more preferable value is 1.7%. In turn, if the addition of exceeding by 7.0% is performed, a coarse compound is formed and fragile. A preferable upper limit value is 6.9% and a more preferable upper limit value is 6.8%.

The aforesaid Al—Cu type alloy can contain more positively one kind or two kinds or more of the following elements.

Mg: 1.8% or less, Mn: 1.2% or less, Cr: 0.4% or less, Zr: 0.3% or less, Zn: 0.5% or less, Ti: 0.3% or less.

All these elements are elements which may contribute to the mechanical properties (strength, ductility, toughness and hardening and the like) as described above.

Of these elements, Mg may contribute to increasing in strength or hardening through aging precipitation of compounds such as $Al_2CuMg$ or $Al_2CuMg_4$ and the like. In particular, in a range of less amount of Cu, a hardening action of it with Mg is mainly applied. However, if the adding value of Mg exceeds 1.8%, a coarse compound may easily be formed and fragile. A more preferable upper limit value is 1.7%.

In addition, Mn, Cr, Zr and Ti may change the crystalline particles into fine particles as described above so as to improve strength, ductility and toughness or the like. If these adding amounts exceed the aforesaid range, a coarse compound may be formed and fragile. A more preferable upper limit value is Mn: 1.1%, Cr: 0.3%, Zr: 0.2% and Ti: 0.2%, respectively. In addition, although Zn may contribute improvement of strength, if the adding amount exceeds 0.5%, a coarse Al—Zn type compound may be formed and fragile. A more preferable upper limit value is 0.4%.

(5) Al—Mn type alloy

Mn: 0.3 to 2.0%

Mn has an action of solid solution hardening and an action to work hardening and may contribute to an increasing of strength. In order to make an effective realization of such actions as described above, it is necessary to add Mn: 0.3% or more and if the amount is lower than 0.3%, it may cause a lack of strength to be produced. A preferable lower limit value is 0.4% and a more preferable lower limit value is 0.5%. In turn, if the amount exceeding 2.0% is added, a coarse compound is formed and fragile. A preferable upper limit value is 1.9% and a more preferable upper limit value is 1.8%.

The aforesaid Al—Mn type alloy can contain positively one kind of or two kinds or more following elements.

Mg: 1.8% or less, Cu: 0.6% or less, Cr: 0.4% or less, Zr: 0.3% or less, Zn: 0.5% or less, Ti: 0.3% or less.

All these elements are elements which may contribute to the mechanical properties (strength, ductility, toughness and hardening and the like) as described above.

Of these elements, Mg may contribute to hardening through enforcing of solid solution. If an adding amount of Mg exceeds 1.8%, a coarse compound is formed and fragile. A more preferable upper limit value is 1.7%.

In addition, Cu forms $Al_2Cu$ or $Al_2CuMg$ and the like and contributes to a hardening. However, if the value exceeds 0.6%, it forms a rough $Al_2CuMg$ and is fragile, so that it is preferable that its upper limit value is 0.6%. A more preferable value is 0.5% or less.

In addition, Cr, Zr and Ti may change the crystalline particles into fine particles as described above so as to improve strength, ductility and toughness or the like. If these adding amounts exceed the aforesaid range, a coarse compound may be formed and fragile. A more preferable upper limit value is Cr: 0.3%, Zr: 0.2% and Ti: 0.2%, respectively.

Although Zn contributes to an improvement of strength, if the adding amount exceeds 0.5%, a coarse Al—Zn type compound is formed and fragile. A more preferable upper limit value is 0.4%.

In addition, the alloy with Fe: 2.0% or less (including 0%) in Al—Mg—Si type alloy of the aforesaid (2) or the alloys of (1) to (5) except Al—Mg—Si type alloy (2) or the alloy with Fe: 2.0% or less (including 0%) and Si: 1.5% or less (including 0%) in the pure Al type alloy are the preferred embodiments of the present invention.

Fe or Si is normally mixed as impurities in Al alloy in an inevitable manner. These elements form various kinds of crystals and precipitates of Al—Fe type [$Al_3Fe$, $Al_mFe$ (m: integers of 3 to 6) and the like] or Al—Fe—Si type (a—AlFeSi and the like) in Al alloys and have actions to make grain refining or workability (rolling, extrusion, drawing and the like).

More practically, in the pure Al system, for example, hardening or forming characteristic in addition to the aforesaid actions can be improved and an improvement in corrosion resistance property can be attained by adding Si.

Also in the aforesaid Al—Mg type alloy, Al—Mg—Si type alloy, Al—Zn—Mg type alloy, Al—Cu type alloy and Al—Mn type alloy, adding of Si or Fe may provide various kinds of influences. In the case of alloy containing Mg such as Al—Mg type alloy or Al—Mg—Si type alloy, for example, aging precipitation such as $Mg_2Si$ can be formed by adding Si and this may contribute to a hardening. In addition, adding of Si may realize the actions to improve strength or corrosion resistance property or get a superior castability.

In order to realize such actions as above in an effective manner, it is preferable to keep them within the aforesaid range, and if the value exceeds this range, a large amount of dispersed particles of Fe or Si are formed, become a cause of breakage and applies a bad influence to toughness. In addition, excessive adding of Fe may produce a reduction in strength. A more preferable value is FE: 1.9% or less and Si: 1.4% or less.

Additionally, it is effective in the aforesaid alloy of the present invention to keep a concentration of residual hydrogen in the alloy in a value of 0.6 ppm or less so as to restrict a blister during a heat treatment such as a hot rolling or the like in particular and make a superior surface state (described in detail in a manufacturing method to be described later). In order to attain the aforesaid object, it is preferable to keep an amount of residual hydrogen as low as possible, although a more preferable value is 0.5 ppm or less and further more preferable value is 0.4 ppm or less in view of comparison of cost, labor and time and the like required for reduction of an amount of hydrogen.

In addition, the alloy of the present invention has a second feature that a rate of $AlB_2$ occupied in all boron compounds satisfies 80% or more in referent to its volumetric rate.

As described above, $AlB_{12}$ is quite stable and hardly decomposed, so that a presence of a large amount of such compound as above may not enable recycling of scrap to be performed. Although $AlB_{12}$ and $AlB_2$ are almost applied as boron compound in the alloy of the present invention, if $AlB_2$ is present by 80% or more in its volumetric rate (that is, $AlB_{12}$ becomes necessarily about 20% or lower), the aforesaid disadvantages can be avoided. A preferable volumetric rate of $AlB_2$ is 85% or more and a more preferable volumetric rate is 90% or more.

The scrap alloy obtained by remelting and reproducing the alloy of the present invention satisfying the aforesaid requirements with boron satisfying a relation of $^{10}B/(^{10}B+^{11}B) \geqq 95\%$ has a superior neutron absorbing capacity and can be reproduced as structural material, so that it is quite useful.

Superior mechanical characteristics (tensile strength and ductility and the like) can be attained by applying a predetermined heat treatment against the Al base alloy containing boron of the present invention. More practically, it is possible to perform a proper selection of preferable heat treatment conditions for getting the superior mechanical properties for every component systems. For example, a quite superior tensile strength of 450 MPa or more can be obtained in Al—Zn—Mg type alloy by applying a solution heat treatment (460 to 500° C.)→quenching (quenching in water and the like)→age hardening heat treatment (115 to 180° C.) after performing hot working such as rolling and extrusion or the like. When the aging hardening heat treatment is carried out, double-stage aging treatments may be performed in which the alloy is kept at a room temperature for a long period of time, thereafter the alloy is held at 120° C. for 24 hours. As to the heat treatment conditions in each of the substances, their example will be described in the preferred embodiments to be explained later.

Then, when the alloy of the present invention is to be manufactured, it is necessary to form a block with condensed boron: 0.5% to 1.5% having a content of isotope $^{10}B$ of 95% or more and at a melting temperature: 900° C. or more to 1200° C. or lower. That is, in order to perform an effective realization of neutron absorbing capacity with the alloy of the present invention, it is useful to apply condensed boron as described above. In order to keep a rate of $AlB_2$ occupied in all boron compounds by 80% or more in a volumetric rate, restrict a production of $AlB_{12}$ and to restrict cohesion of the boron compound, it is necessary to keep a melting temperature by 900° C. or more. A preferable melting temperature is 920° C. or more and a more preferable melting temperature is 940° C. or more. If the value is 900° C. or lower, since disadvantages that a coarse $AlB_{12}$ compound is generated and B is segregated are produced, it is not possible to make an effective realization of the action of the present invention. In turn, if the value is 1200° C. or more, Mg is evaporated and it becomes difficult to keep a required strength. A preferable upper limit value is 1180° C. and a more preferable upper limit value is 1150° C.

In addition, in order to make an effective realization of the effects of the present invention, it is preferable to keep a cooling rate during casting operation at a value of 0.1° C./sec or more. A more preferable value is 0.2° C./sec or more, a further more preferable value is 0.3° C./sec or more and its upper limit value is not specifically defined.

In addition to the aforesaid solidifying speed, it is also effective to form blocks under a pressure of 500 Torr or less. Upon studying, the present inventors have found that when the alloy of the present invention is tried to be manufactured under a normal atmospheric condition (1 atm, 760 Torr), vacant holes are produced in ingot due to water vapor ($H_2$ gas) in the air, the gas is expanded during a hot working performed after that to cause a bulging of the alloy, resulting in that defects such as vacant holes may be produced at the surface of the alloy, a segregation of boron is found at each of the portion in the ingot and a neutron absorbing power is badly influenced. In view of the aforesaid facts, it is preferable that a pressure during casting operation is set to a value of 500 Torr or less in order to reduce an amount of moisture in the air. In view of the aforesaid gist, although the smaller the lower limit value (that is, approximating to vacuum state), the better its result, a more preferable value is 400 Torr or less and a further more preferable value is 300 Torr or less in view of cost, labor and time accompanied by a reduction in pressure.

As described above, the method of the present invention has a feature that the aforesaid condensed boron is used and a melting temperature is controlled and preferably a cooling rate or a pressure during casting operation is controlled, and other conditions may not be limited, but the alloy can be manufactured by a method normally applied (for example, a hot rolling, an extrusion and a casting and the like) within a range not damaging the object of the present invention.

It has been found that since the Al base alloy containing boron of the present invention is composed as described above, it has a superior neutron absorbing capacity, superior mechanical properties such as strength and ductility as well, a better hot rolling workability and recycling of scrap can be performed. In addition, employing of the method of the present invention enables the aforesaid alloy to be efficiently manufactured, controlling of a cooling rate or pressure during casting operation enables the aforesaid various properties to be improved and also a surface state of the hot rolled plate may become more superior. In these alloys, Al—Mg type alloy in particular is relatively less-expensive and it is useful in view of a reduction in manufacturing cost.

DESCRIPTION OF THE PREFERRED EMBODIMENTS

Referring now to the preferred embodiments, the present invention will be described as follows. The following preferred embodiments do not restrict the present invention, and all their modifications are included within a technical range of the present invention without departing from the aforesaid gists and also other gists to be described later.

Embodiment 1

Al—Mg type alloys having composition indicated in Table 1 (Nos. 1 to 18, all balances are Al) were changed into blocks under the following casting conditions A to C and X to Z, respectively.

A: melting temperature 900° C. cooling rate 0.1° C./sec
B: melting temperature 720° C. cooling rate 0.1° C./sec
C: melting temperature 900° C. cooling rate 0.05° C./sec
X: melting temperature 1300° C. cooling rate 0.1° C./sec
Y: melting temperature 900° C. cooling rate 1° C./sec
Z: melting temperature 1000° C. cooling rate 0.1° C./sec After the ingots obtained in this way were soaked (at 480° C., for 24 hours), they were hot rolled (at a temperature of 500° C. and a total rolling reduction of 85%) and a state of their hot rolling workability was evaluated in accordance with the following standards.

○: no cracks
X: cracks

Figure 1A:
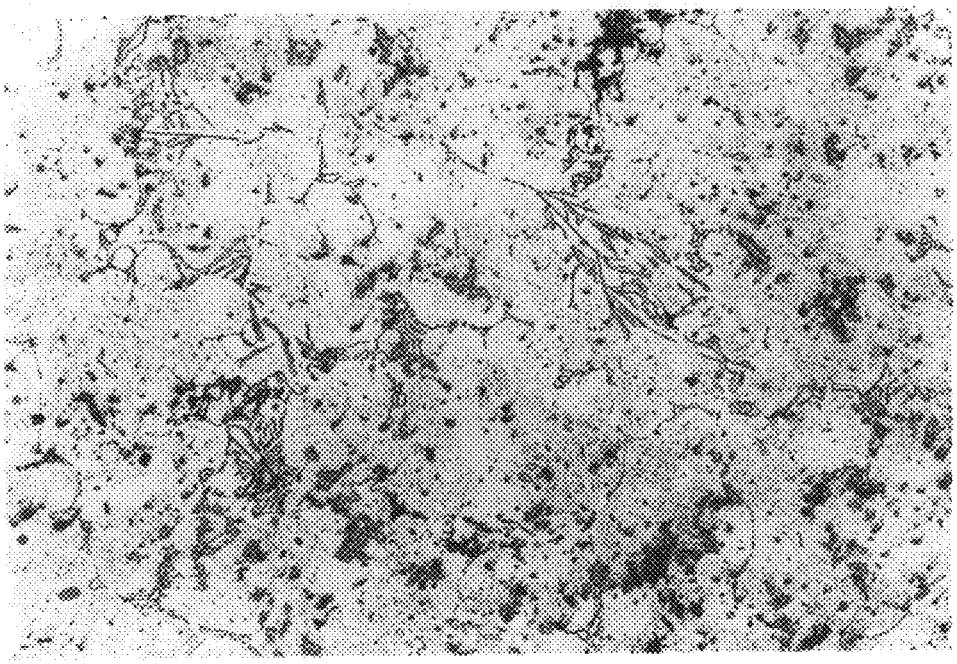
FIGS. 1(*a*) and 1(*b*) are photographs for showing a structure in an embodiment 1.
Figure 1B:
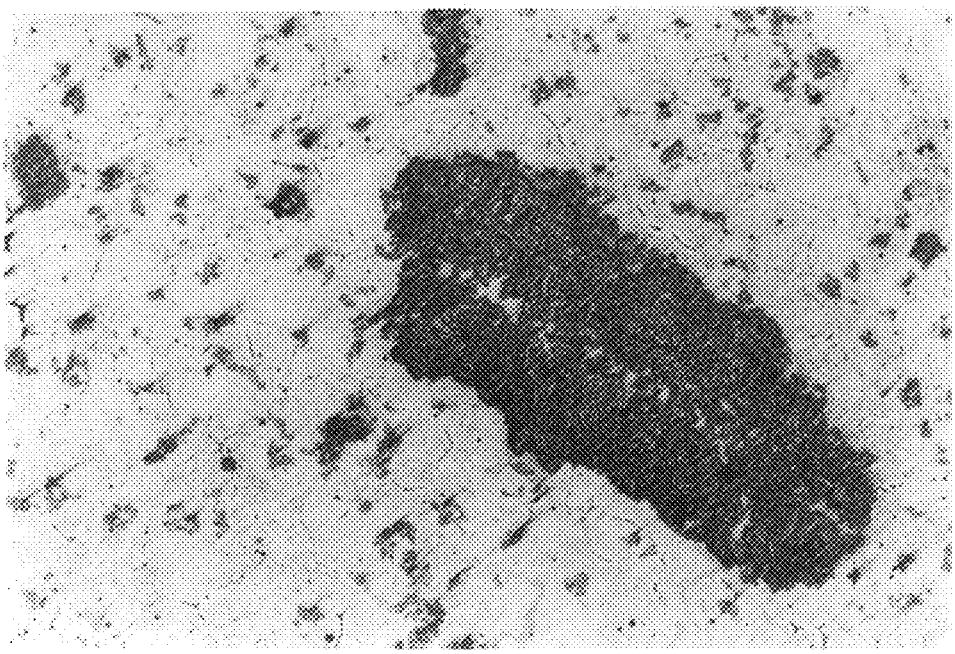

Tensile test plate pieces (JIS No.13, type B) were cut from a plate of which thickness was set to 20 mm by a hot rolling process, processed by a T4 treatment (a solution heat-treatment at 530° C. for 1 hour) and a stabilizing treatment (at 150° C. for 2 hours), and then their strength at a room temperature and their elongations were measured by performing a tensile test (JIS Z 2241). Then, these plates were casted again at a melting temperature: 900° C. or more and at a cooling rate during casting: 0.1° C./sec and it was checked if the scrap can be reproduced. In addition, a volumetric rate of $AlB_2$ was checked by an X-ray diffraction and its structure was observed by an optical microscope (a multiplication rate: 50 times or 100 times). Obtained results are totally indicated in Table 2 and their representing photograph of structure is shown in FIGS. 1(*a*) and 1(*b*). FIG. 1(*a*) shows a photograph of No.1 of the example of the present invention and FIG. 1(*b*) shows a photograph of No.2 which is an example of comparison, respectively.

In reference to these results, the present invention can be considered as follows.

It was made apparent that all the Al—Mg type alloys satisfying all the requirements of the present invention were superior in view of strength and ductility, $AlB_2$ was present by 80% or more, $AlB_2$ was uniformly dispersed, cohesion of boron compound was not acknowledged at all and it had a superior neutron absorbing capacity. In addition, its hot rolling workability was superior and recycling of the scrap could be carried out. Of these alloys, alloys (Nos.13 to 18) containing Cu, Mn, Cr, Zr, Zn or Ti of which amounts exceed the range of the present invention had a slight reduced ductility but satisfied other properties.

To the contrary, the alloy not satisfying the requirements of the present invention showed disadvantages that a neutron absorbing capacity was reduced, a hot rolling workability was deteriorated, a scrap could not be recycled or strength or elongation was reduced.

Embodiment 2

Al—Mg type alloys having composition shown in Table 3 (all the balances are Al) were applied and they were formed under casting conditions of embodiment 1 or the casting conditions of the following D. Since Nos.1 to 6 in the Table have the same compositions and casting conditions as those indicated in the aforesaid Table 1, similar numbers are affixed.

D: melting temperature 1180° C. cooling rate 0.1° C./sec

Figure 2:
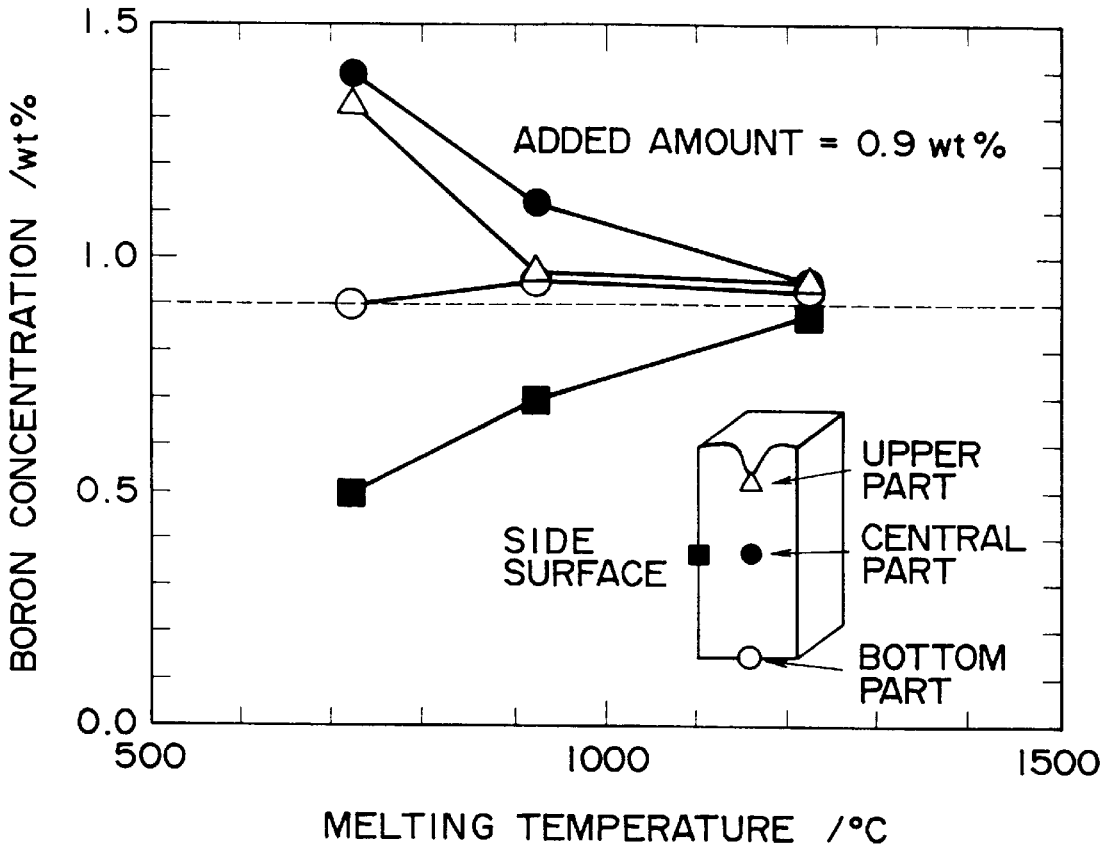
FIG. 2 is a graph for showing a relation between a melting temperature and a boron concentration in an embodiment 2.

As to the ingots (Nos.1, 2 and 19) partially manufactured in this way, the test pieces with a rectangular size of 15 cm were cut out from each of the portions (upper part, central part, side surfaces and bottom part) of each of the ingots and a boron concentration at each of the locations was checked by an ICP method. The test results are indicated in FIG. 2.

Then, after each of the ingots was soaked and hot rolled in the same manner as that of embodiment 1, a state of boron compound (a volumetric rate of $AlB_2$ and a presence or non-presence of segregation), availability or non-availability of recycling of scrap and a degree of segregation of boron were checked. As to the degree of segregation of boron, a concentration of B at each of the portions in the ingot was measured by an IPC method and evaluated in reference to the following standards.

Segregation: There is a part indicating a value exceeding B: 0.5 to 1.5% at any portions in the ingot No segregation: All the locations in the ingot satisfy B: 0.5 to 1.5%

The results obtained in this way are totally indicated in Table 4.

In reference to these results, it is possible to consider them as follows.

It has been found that all the alloys obtained by the method of the present invention have no segregation of boron or no cohesion of boron compounds and $AlB_2$ of 80% or more is present in them, so that the scrap can be reproduced and at the same time they had a superior strength and ductility. To the contrary, the alloy not produced by the present invention generated disadvantages that the neutron absorbing capacity was low, an ability in recycling of scrap caused by segregation of boron was poor and strength was reduced.

Embodiment 3

Al—Mg—Si type alloys (Nos. 28 to 47, all the balances are Al) having a composition indicated in Table 5 were formed into blocks in the same manner as that of the embodiment 1.

After the ingot obtained in this way was soaked (at 550° C. for 8 hours), the ingot was hot rolled (temperature: 500° C., total rolling reduction: 85%) and a state of hot rolling workability was evaluated in the same standards as that of the embodiment 1.

Figure 3A:
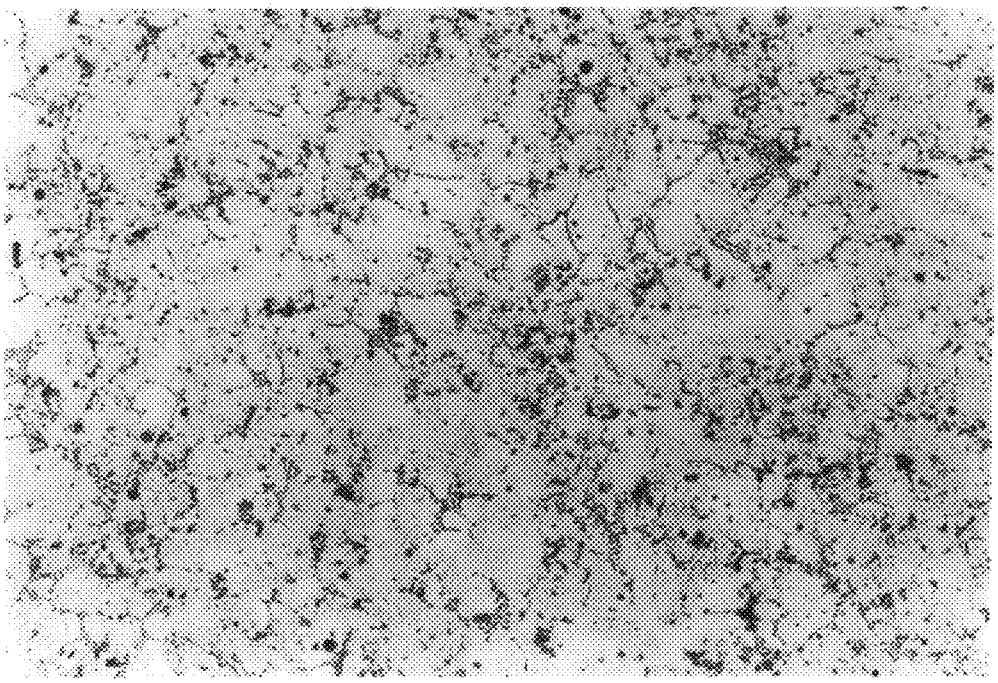
FIGS. 3(*a*) and 3(*b*) are photographs for showing a structure in an embodiment 3.
Figure 3B:
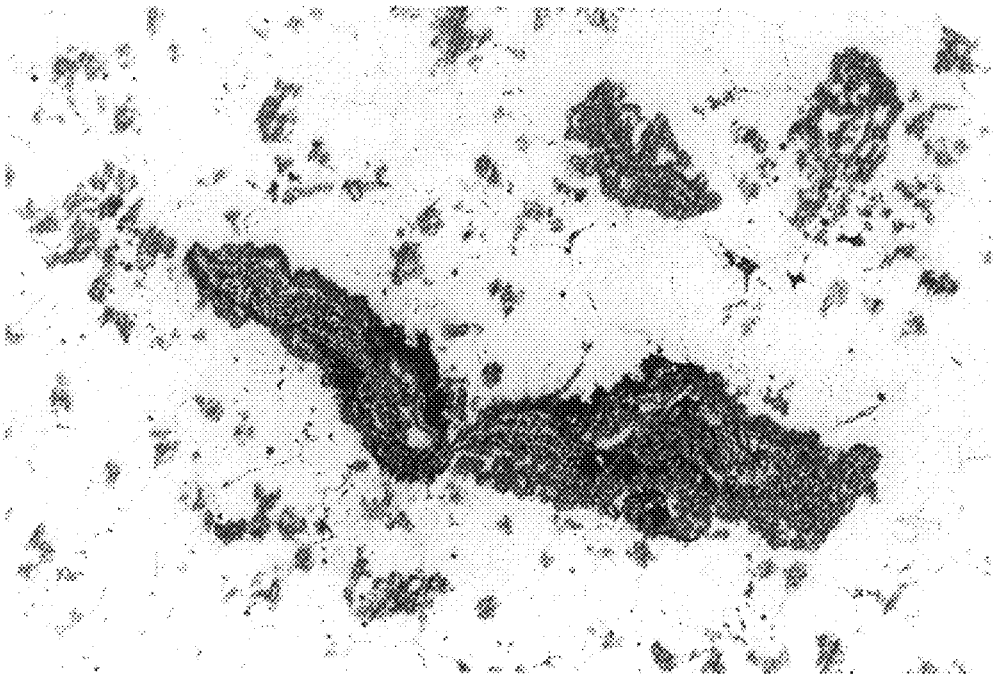

Then, tensile test plate pieces (JIS No.13, type B) were cut from a plate of which thickness was set to 20 mm by a hot rolling process, processed by a T6 treatment (a solution heat-treatment at 530° C. for 1 hour and aging treatment at 180° C. for 24 hours), and then their strength at a room temperature and their elongations were measured by performing a tensile test in the same manner as that of the embodiment 1. Then, these plates were casted again in the same manner as that of embodiment 1, it was checked if recycling of the scrap could be performed, a volumetric rate of boron compound and a degree of cohesion were checked by an X-ray diffraction and a structure of it was also observed. Obtained results are totally indicated in Table 6 and their representing photograph of structure is shown in FIGS. 3(*a*) and 3(*b*). FIG. 3(*a*) shows a photograph of No.28 of the example of the present invention and FIG. 3(*b*) shows a photograph of No.29 which is an example of comparison, respectively.

In reference to these results, it is possible to consider them as follows.

It has been found that all the Al—Mg—Si alloys satisfying all the requirements of the present invention were superior in strength and ductility, had $AlB_2$ of 80% or more and had no cohesion of boron compound. It was also found that the hot rolling workability was superior and recycling of the scrap could be performed. Of these elements, all the alloys (Nos.42 to 47) in which amounts of Cu, Mn, Cr, Zr, Zn or Ti exceed the range of the present invention had superior properties other than the fact that their ductility was slightly reduced.

To the contrary, the alloy which did not fulfill the requirement of the present invention showed disadvantages that a neutron absorbing capacity was reduced, a poor ability in recycling of scrap was caused by a reduction in a hot rolling workability and a reduction in strength occurred.

Embodiment 4

Al—Mg—Si type alloys having compositions shown in Table 7 (all the balances are Al) were formed into blocks under a casting condition applied in the embodiment 2. Since Nos.28 to 33 in Table 7 had the same compositions and were applied with the same casting methods as those shown in Table 5 above, same reference numbers were added.

Figure 4:
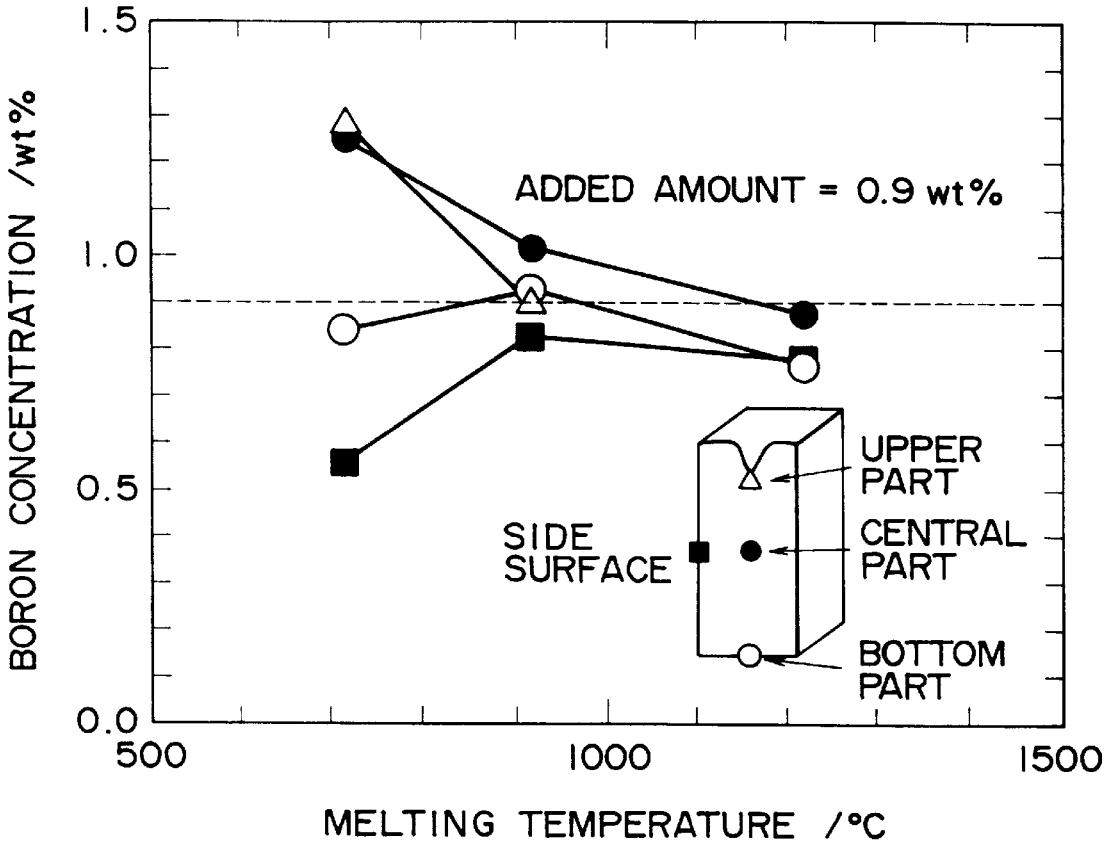
FIG. 4 is a graph for showing a relation between a melting temperature and a boron concentration in an embodiment 4.

As to some ingots obtained in this way (Nos.28, 29 and 48), a segregation of boron was checked in the same manner as that of the embodiment 2. The results are indicated in FIG. 4.

A form of boron compound, an availability or an unavailability of recycling of scrap and a degree of segregation of boron were checked and structures were observed. Obtained results are totally indicated in Table 8.

In reference to these results, it is possible to consider them as follows.

It has been found that all the Al—Mg—Si type alloys obtained by the method of the present invention have no segregation of boron or no cohesion of boron compounds and $AlB_2$ of 80% or more is present in them, so that the scrap can be recycled and at the same time they had a superior strength and ductility.

To the contrary, the alloy not produced by the present invention generated disadvantages that the neutron absorbing capacity was reduced, an ability in recycling of scrap caused by cohesion of boron was poor and strength was reduced.

Embodiment 5

Al—Mg type alloys having compositions indicated in Table 9 and Al—Mg—Si type alloys having compositions indicated in Table 10 (all the balances are Al) were applied, a pressure within the furnace was set as indicated in the Tables and the alloys were formed into blocks under the casting condition A in the embodiment 1.

As to the ingots obtained in this way, a concentration of the residual hydrogen in each of the ingots was measured by a vacuum heating extraction specified volume pressure measuring method. In addition, as to some ingots (Nos.57 and 61), test pieces with 15 cm rectangular size were cut out of each of the portions of each of the ingots and a concentration of boron was measured by an ICP method.

After each of the ingots was soaked (at 480° C., for 24 hours), they were hot rolled (at a temperature of 500° C. and a total rolling reduction of 80%) and a degree of segregation of boron as well as a surface state of the hot rolled plate were evaluated as described below.

[Degree of Segregation of Boron]

X: Out of a range of B: 0.5 to 1.5% at any part in the ingot.

○: Although satisfying a range of B: 0.5 to 1.5% at each of the portions in the ingot, it has a substantial fluctuation.

◎: Satisfying a range of B: 0.5 to 1.5% at each of the portions in the ingot and having a low fluctuation.

[Availability or Unavailability of a Surface State of a Rolled Plate]

◎: No occurrence of bulging

○: Scarce presence of bulging

X: Bulging

Obtained results are indicated in Tables 11 to 13. Total evaluation described in Tables 11 and 12 is a result of total judgment in consideration of a neutron absorbing capacity, a form of boron compound and a presence or a non-presence of cohesion in addition to a segregation or boron or a surface state of a rolled plate.

In reference to these results, it is possible to consider them as follows.

Nos.60 to 64 and Nos.71 to 75 are examples in which a concentration of residual hydrogen is controlled within a preferable range of the present invention by adjusting a pressure during a casting operation. It is apparent from these examples that a degree of segregation of boron is remarkably improved and a surface state of the plate during a hot rolling operation is also superior as compared with the examples (Nos.57 to 59 and Nos.68 to 70) having no such controls as above.

Embodiment 6

Al—Zn—Mg type alloys (Nos.79 to 97, all the balances are Al) having compositions shown in Table 14 were formed into blocks in the same manner as that of embodiment 1.

After the ingot obtained in this way was soaked (at 480° C. for 24 hours), the ingot was hot rolled (temperature: 480° C., total rolling reduction: 85%) and availability or unavailability of a hot rolling characteristic was evaluated on the basis of the same standard as that of embodiment 1.

Figure 5A:
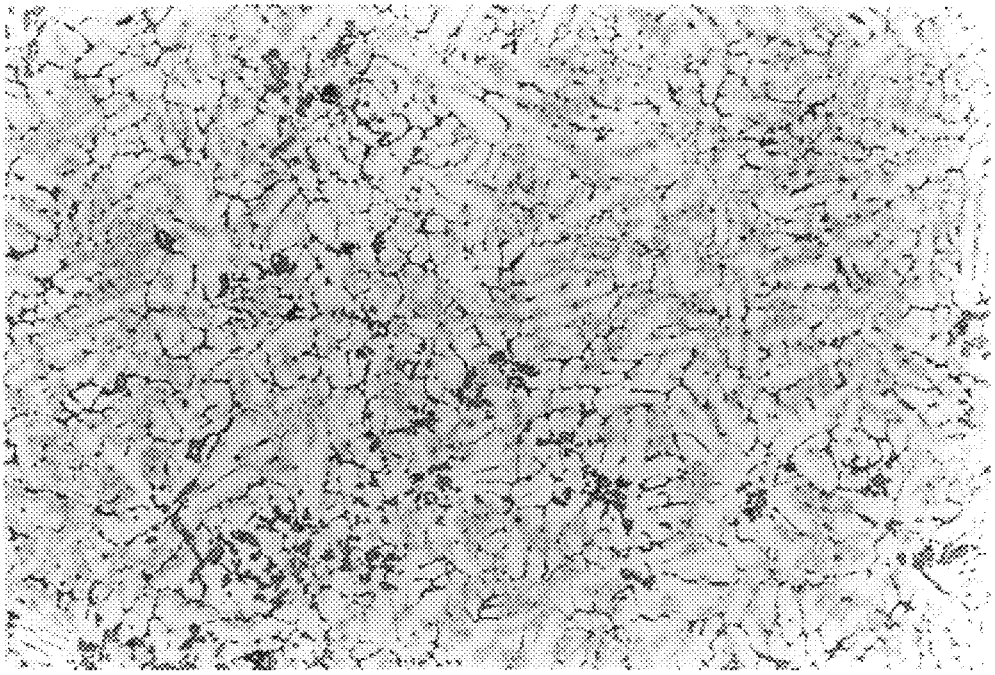
FIGS. 5(*a*) and 5(*b*) are photographs for showing a structure in an embodiment 6.
Figure 5B:
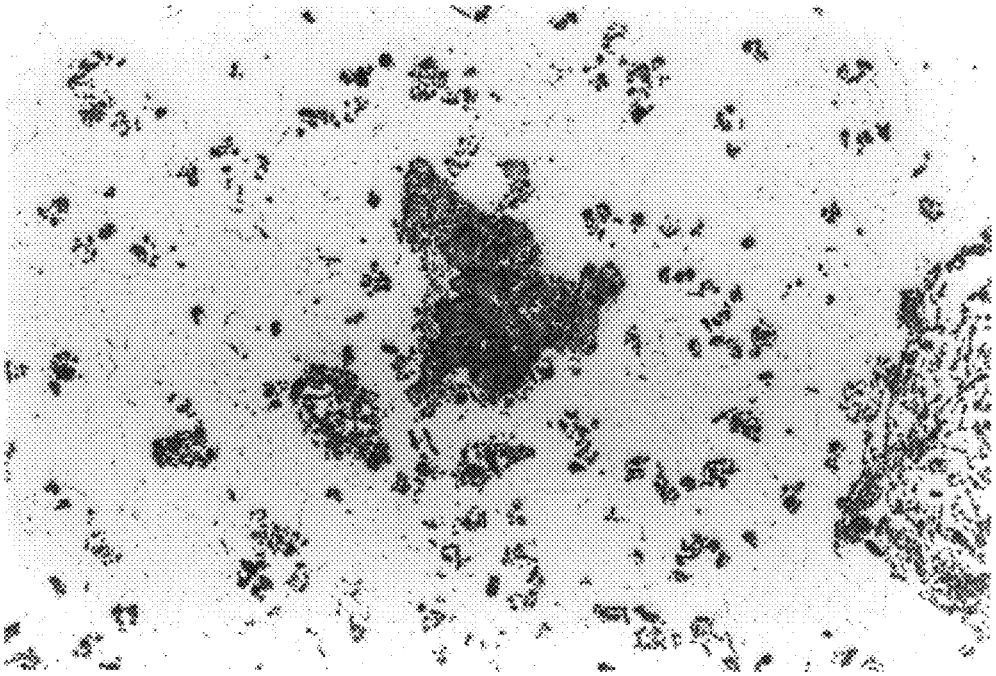

Then, tensile test pieces (JIS No.13, type B) were cut out of the plate having a thickness of 20 mm hot rolled, processed by T6 treatment (after performing a solution heat-treatment at 480° C. for 1 hour, a cold water quenching is carried out and an age hardening heat treatment is performed at 120° C. for 24 hours), then a tensile test was carried out in the same manner as that of embodiment 1, their strength at room temperature and elongation were measured. In addition, these plates were casted again in the same manner as that of the embodiment 1, availability or unavailability of recycling of scrap was checked, a volumetric rate of boron compound and a degree of cohesion were checked by an X-ray diffraction and their structures were observed. All the obtained results are described in Table 15 and the photographs of representing structure are indicated in FIGS. 5(*a*) and 5(*b*). FIG. 5(*a*) indicates a photograph of No.79 of the example of the present invention and FIG. 5(*b*) indicates a photograph of No.80 which is an example of comparison, respectively.

In reference to these results, it is possible to consider them as follows.

It has been found that all the Al—Mg—Si type alloys satisfying all the requirements of the present invention are superior in strength and ductility, $AlB_2$ of 80% or more is present in them and there is no cohesion of boron compound. Further, it has been found that their hot rolling workability are also superior and recycling of scrap can be carried out. All these alloys (Nos.93 to 97) in which amounts of Cu, Mn, Cr, Zr or Ti exceeding the range of the present invention had superior properties except the fact that a ductility was slightly reduced.

To the contrary, the alloys not satisfying the requirements of the present invention generated disadvantages of a reduction of neutron absorbing capacity, a poor ability in recycling of scrap caused by a reduction in hot rolling workability and a reduction in strength.

Embodiment 7

Al—Zn—Mg type alloys having compositions shown in Table 16 (the balances are Al) were applied to form blocks under the casting conditions in the embodiment 2. Since Nos.79 to 84 in the Table have the same composition as that of Table 14 and are processed by the same casting method as that of Table 14, the same numbers are applied.

Figure 6:
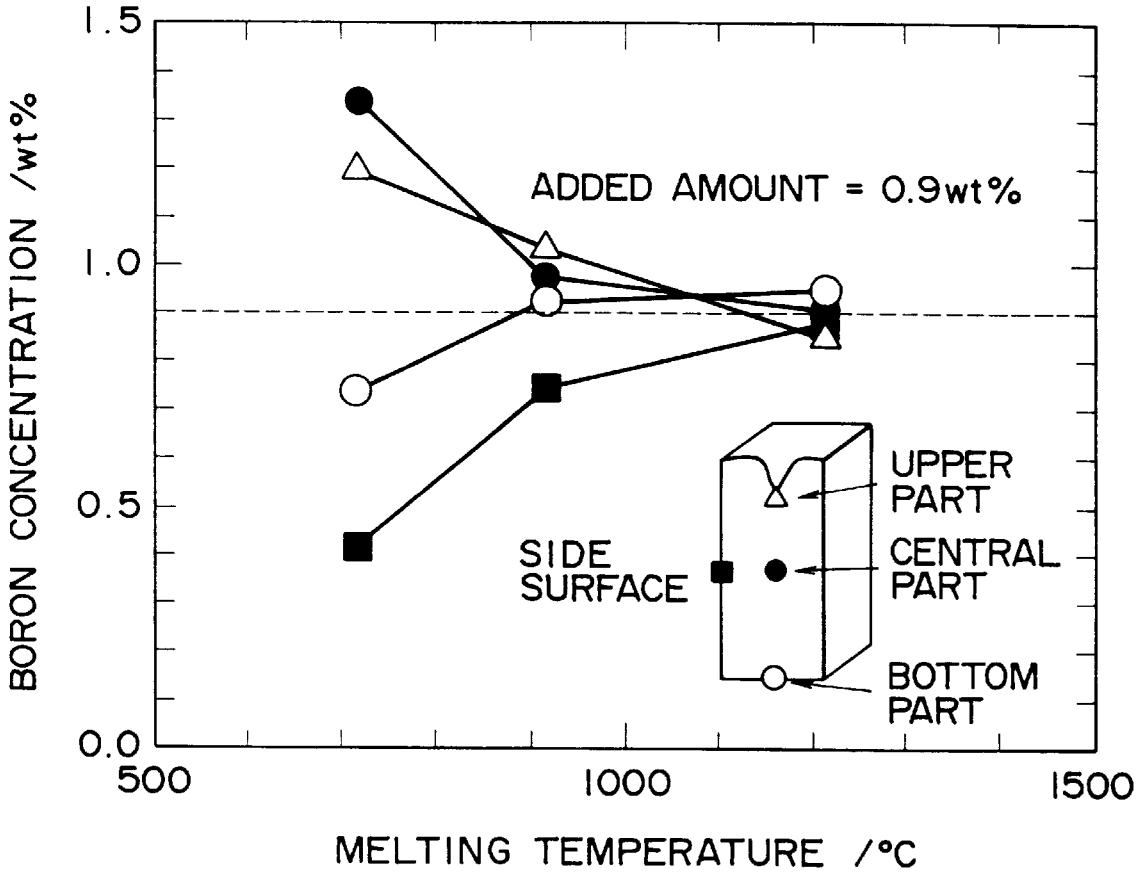
FIG. 6 is a graph for showing a relation between a melting temperature and a boron concentration in an embodiment 7.

As to the partial ingots (Nos.79, 80 and 98) obtained in this way, a segregation of boron in each of them was checked in the same manner as that of embodiment 2. The results are indicated in FIG. 6.

Then, a mode of boron compound, availability or non-availability of recycling of scrap and a degree of a segregation of boron for each of the ingots were checked in the same manner as that of the embodiment 3.

In reference to these results, it is possible to consider them as follows.

It has been found that all the Al—Mg—Si type alloys produced by the method of the present invention had no segregation of boron or no cohesion of boron compound and had $AlB_2$ of 80% or more, so that it is possible to recycle and they are superior in strength and ductility as well.

To the contrary, the alloy not made by the method of the present invention showed a reduction in neutron absorbing capacity, a poor ability in recycling of scrap based on cohesion of boron compound and a reduction in strength.

Embodiment 8

Al—Zn—Mg type alloy of No.79 was applied and it was checked how a strength was varied in response to a presence or a non-presence of the age hardening heat treatment performed in the embodiment 6. The strength at a room temperature was measured by performing a tensile test in the same manner as that of the embodiment 1. The results are indicated in Table 18.

As apparent from the results shown in the table, it was possible to increase the tensile strength up to 500 MPa by performing the aforessid age hardening heat treatment.

Embodiment 9

Al—Cu type alloys having compositions shown in Table 19 (Nos.107 to 124, all the balances are Al) were formed into blocks in the same manner as that of the embodiment 1.

After each of the ingots was soaked (at 490° C. for 24 hours), a hot rolling was carried out (a temperature: 400° C., a total rolling reduction: 85%) and an availability or a unavailability of a hot rolling workability was evaluated on the basis of the same standard as that of the embodiment 1.

Figure 7A:
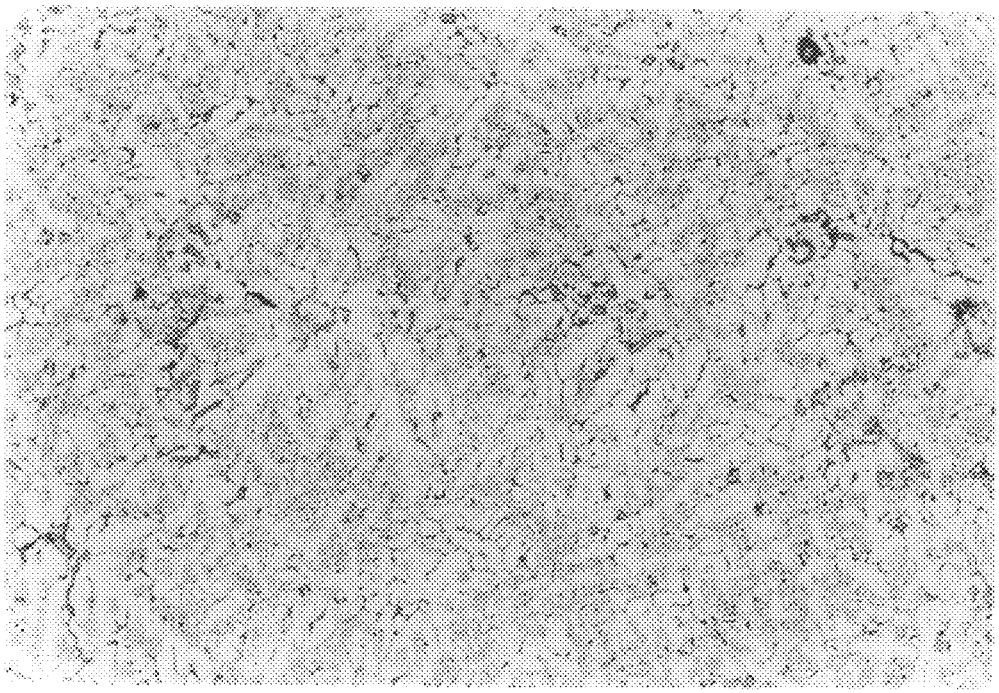
FIGS. 7(*a*) and 7(*b*) are photographs for showing a structure in an embodiment 9.
Figure 7B:
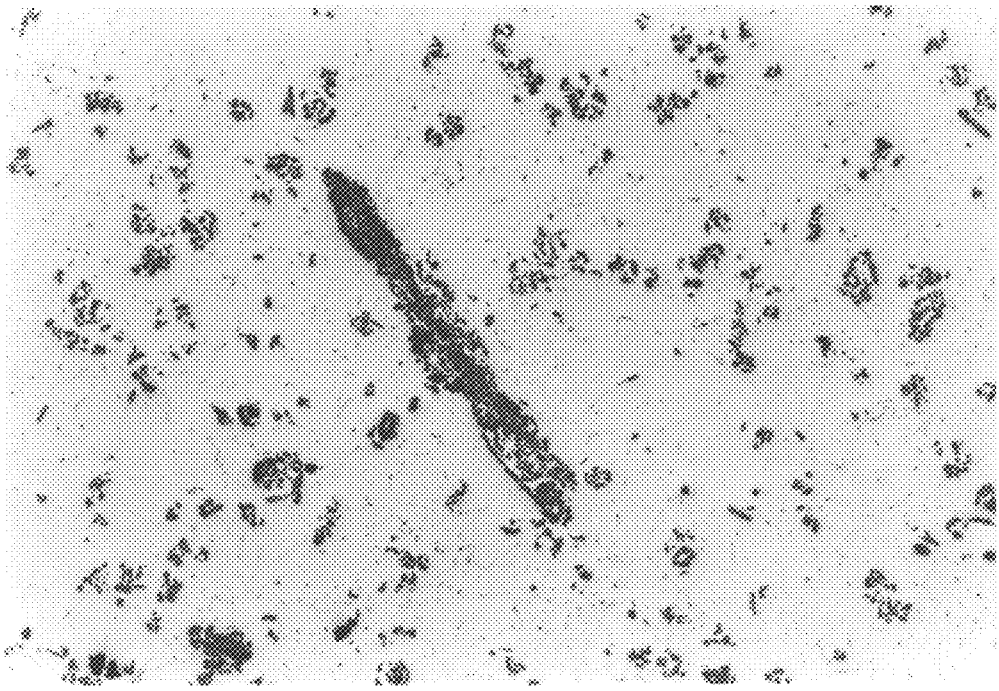

Then, tensile test pieces (JIS No.13, type B) were cut out of the plate having a hot rolled thickness of 20 mm, processed by T6 treatment (performing a solution heat-treatment at 500° C. for 1 hour and an age hardening heat treatment performed at 180° C. for 10 hours), then a tensile test was carried out in the same manner as that of the embodiment 1, their strength at room temperature and elongation were measured. In addition, these plates were casted again in the same manner as that of the embodiment 1, an availability or unavailability of recycling of scrap was checked, a volumetric rate of boron compound and a degree of cohesion of boron compound were checked by an X-ray diffraction and their structures were observed. All the obtained results are described in Table 20 and the photographs of representing structures are indicated in FIGS. 7(*a*) and 7(*b*). FIG. 7(*a*) indicates a photograph of No.107 of the example of the present invention and FIG. 7(*b*) indicates a photograph of No.108 which is an example of comparison, respectively.

In reference to these results, it is possible to consider them as follows.

It has been found that all the Al—Cu type alloys satisfying all the requirements of the present invention are superior in strength and ductility, $AlB_2$ of 80% or more is present in them and there is no cohesion of boron compound. Further, it has been found that their hot rolling workability are also superior and recycling of scrap can be carried out. All these alloys (Nos.119 to 124) in which amounts of Mg, Mn, Cr, Zr, Zn or Ti exceed the range of the present invention had superior properties except the fact that a ductility was slightly reduced.

To the contrary, the alloys not satisfying the requirements of the present invention generated disadvantages of a reduction of neutron absorbing power, a poor ability in recycling of scrap caused by a reduction in hot rolling workability and a reduction in strength.

Embodiment 10

Al—Cu type alloys having compositions shown in Table 21 (the balances are Al) were applied to form blocks under the casting conditions in the embodiment 2. Since Nos.107 to 112 in the Table have the same composition as that of Table 19 and are processed by the same casting method as that of Table 19, the same numbers are applied.

Figure 8:
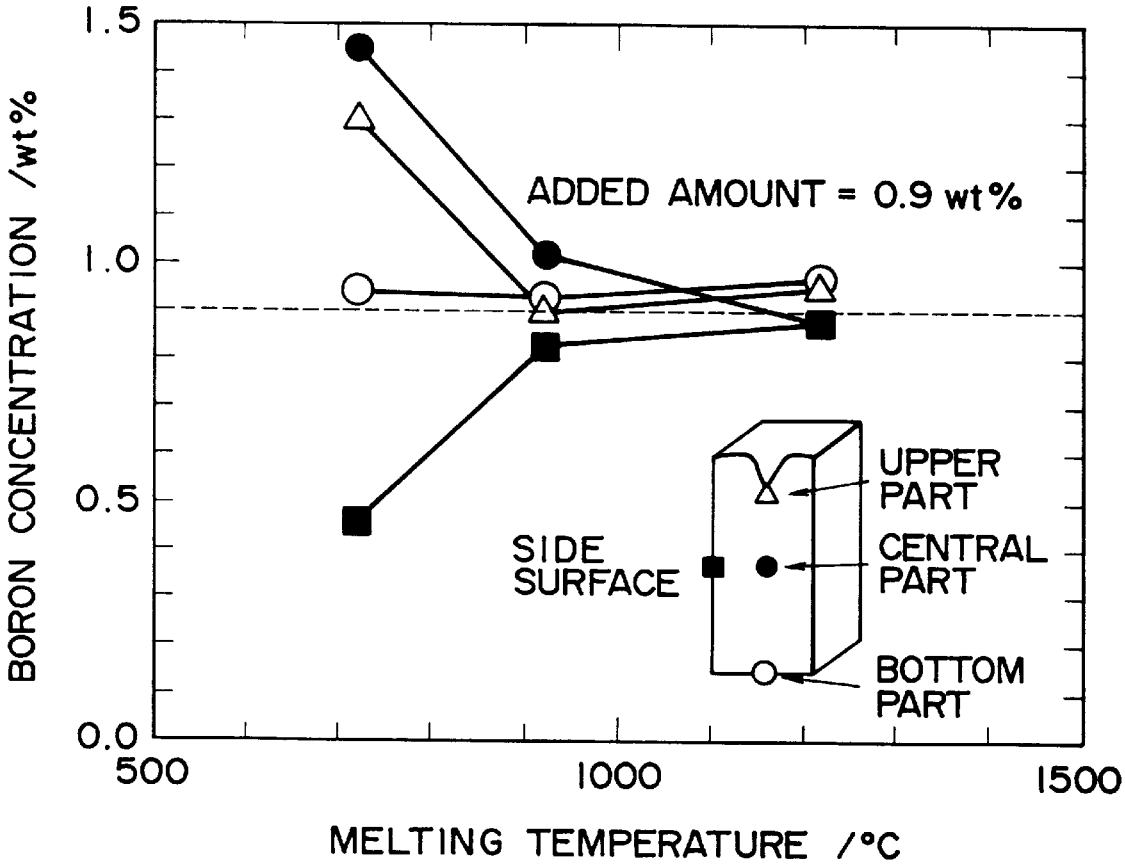
FIG. 8 is a graph for showing a relation between a melting temperature and a boron concentration in an embodiment 10.

As to the partial ingots (Nos.107, 108 and 125) obtained in this way, a segregation of boron in each of them was checked in the same manner as that of embodiment 2. The results are indicated in FIG. 8.

Then, a mode of boron compound, an availability or unavailability of recycling of scrap and a degree of segregation of boron for each of the ingots were checked in the same manner as that of the embodiment 3. All the results obtained are indicated in Table 3.

In reference to these results, it is possible to consider them as follows.

It has been found that all the Al—Cu type alloys obtained by the method of the present invention had no segregation of boron or no cohesion of boron compound and had $AlB_2$ of 80% or more, so that recycling of the scrap could be carried out and further they were superior in strength and ductility as well.

To the contrary, the alloy not made by the method of the present invention showed a reduction in neutron absorbing capacity, a poor ability in recycling of scrap based on cohesion of boron compound and a reduction in strength.

Embodiment 11

Al—Mn type alloys having compositions shown in Table 23 (Nos.134 to 151, all the balances are Al) were formed into blocks in the same manner as that of the embodiment 1.

After each of the ingots obtained in this way was soaked (at 570° C. for 10 hours), a hot rolling was carried out (a temperature: 450° C., a total rolling reduction: 85%) and an availability or a unavailability of a hot rolling workability was evaluated on the basis of the same standard as that of the embodiment 1.

Figure 9A:
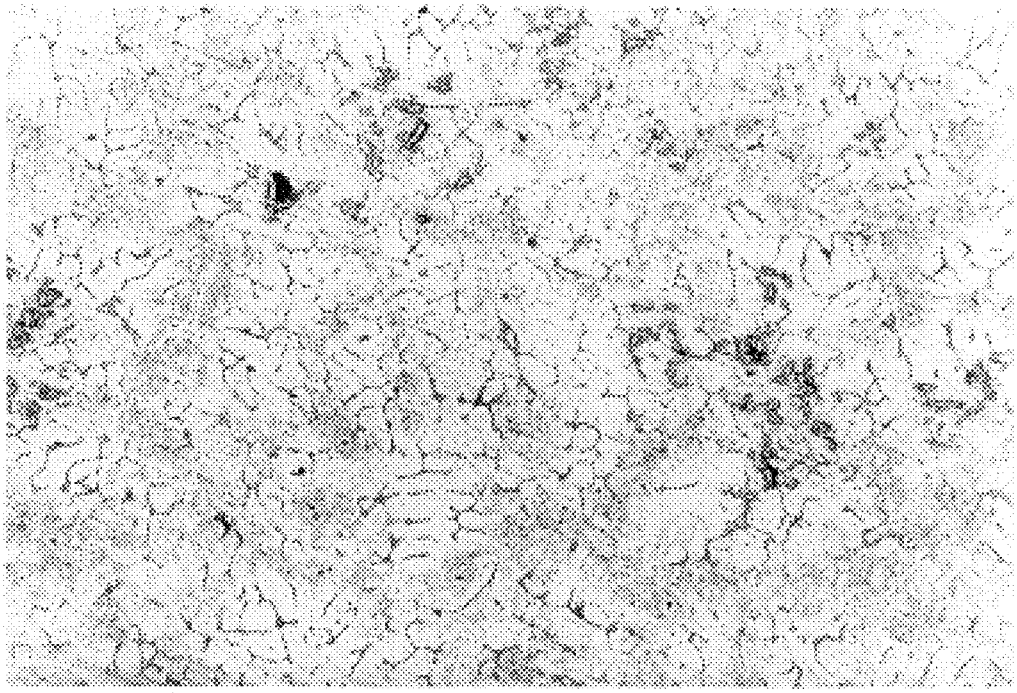
FIGS. 9(*a*) and 9(*b*) are photographs for showing a structure in an embodiment 11.
Figure 9B:
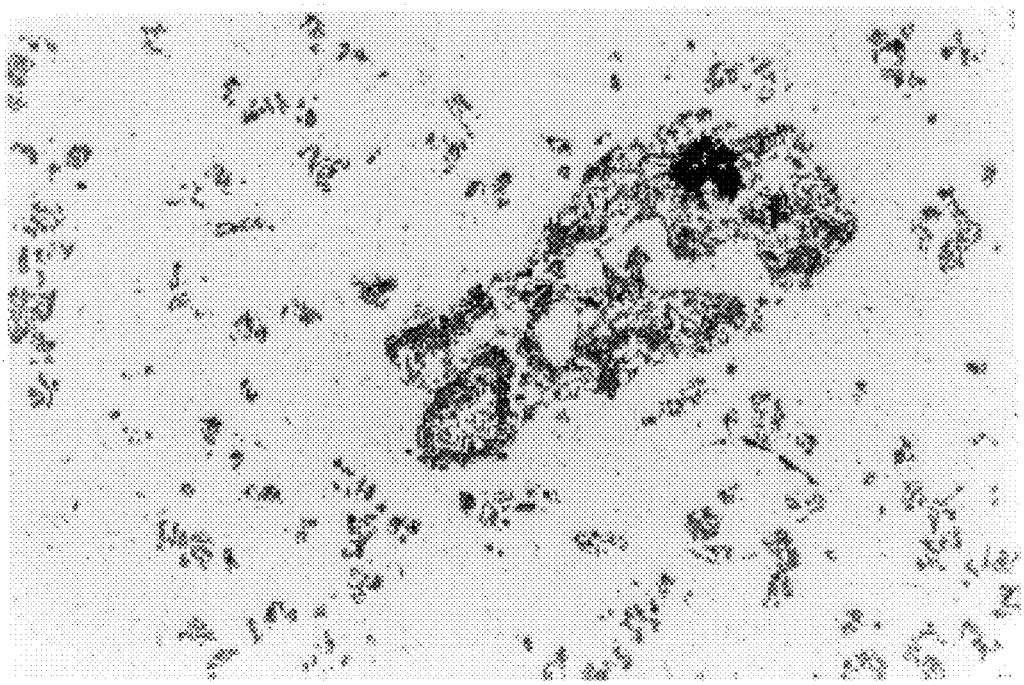

Then, tensile test pieces (JIS No.13, type B) were cut out of the plate having a hot rolled thickness of 20 mm, processed by an annealing process (at 200° C. for 1 hour), thereafter their strength at room temperature and elongation were measured. In addition, these plates were casted again in the same manner as that of the embodiment 1, an availability or unavailability of recycling of scrap was checked, a volumetric rate of boron compound and a degree of cohesion of boron compound were checked by an X-ray diffraction and their structures were observed. All the obtained results are described in Table 24 and the photographs of representing structures are indicated in FIGS. 9(*a*) and 9(*b*). FIG. 9(*a*) indicates a photograph of No.134 of the example of the present invention and FIG. 9(*b*) indicates a photograph of No.135 which is an example of comparison, respectively.

In reference to these results, it is possible to consider them as follows.

It has been found that all the Al—Mn type alloys satisfying all the requirements of the present invention are superior in strength and ductility, $AlB_2$ of 80% or more is present in them and there is no cohesion of boron compound. Further, it has been found that their hot rolling workability are also superior and a recycling of scrap can be carried out. All these alloys (Nos.146 to 151) in which amounts of Mg, Cu, Cr, Zr, Zn or Ti exceed the range of the present invention had superior properties except the fact that a ductility was slightly reduced.

To the contrary, the alloys not satisfying the requirements of the present invention generated disadvantages of a reduction of neutron absorbing capacity, a poor ability in recycling of scrap caused by a reduction in hot rolling workability and a reduction in strength.

Embodiment 12

Al—Mn type alloys having compositions shown in Table 25 (the balances are Al) were applied to form blocks under the casting conditions in the embodiment 2. Since Nos.134 to 139 in the Table have the same composition as that of Table 23 and are processed by the same casting method as that of Table 23, the same numbers are applied.

Figure 10:
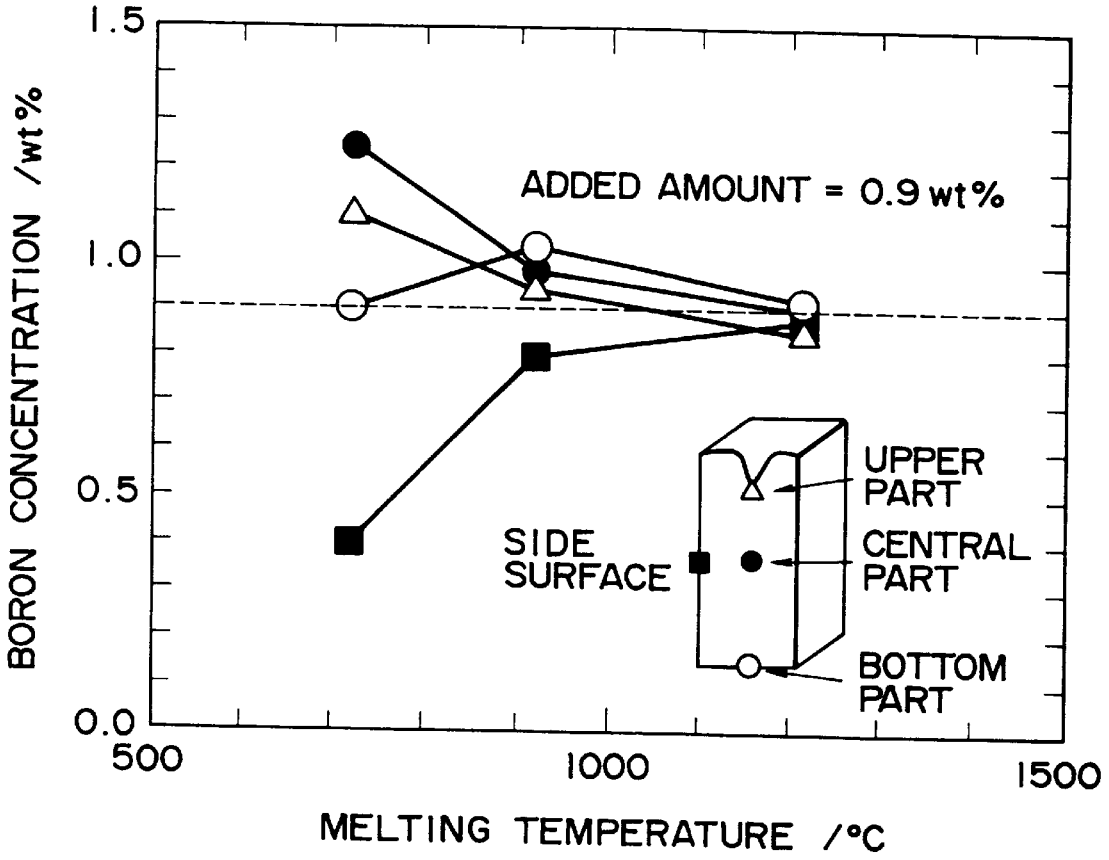
FIG. 10 is a graph for showing a relation between a melting temperature and a boron concentration in an embodiment 12.

As to the partial ingots (Nos.134, 135 and 152) obtained in this way, a segregation of boron in each of them was checked in the same manner as that of embodiment 2. The results are indicated in FIG. 10.

Then, a mode of boron compound, an availability or unavailability of recycling of scrap and a degree of segregation of boron for each of the ingots were checked in the same manner as that of the embodiment 3. All the results obtained are indicated in Table 26.

In reference to these results, it is possible to consider them as follows.

It has been found that all the Al—Mn type alloys obtained by the method of the present invention had no segregation of boron or no cohesion of boron compound and had $AlB_2$ of 80% or more, so that recycling of scrap could be carried out and further they were superior in strength and ductility as well.

To the contrary, the alloy not made by the method of the present invention showed a reduction in neutron absorbing capacity, a poor ability in recycling of scrap based on cohesion of boron compound and a reduction in strength.

Embodiment 13

Pure Al type alloys having compositions shown in Table 27 (Nos.163 to 176, all the balances are Al) were formed into blocks in the same manner as that of the embodiment 1.

After each of the ingots obtained in this way was soaked (at 490° C. for 24 hours), a hot rolling was carried out (a temperature: 400° C., a total rolling reduction: 85%) and an availability or a unavailability of a hot rolling workability was evaluated on the basis of the same standard as that of the embodiment 1.

Figure 11A:
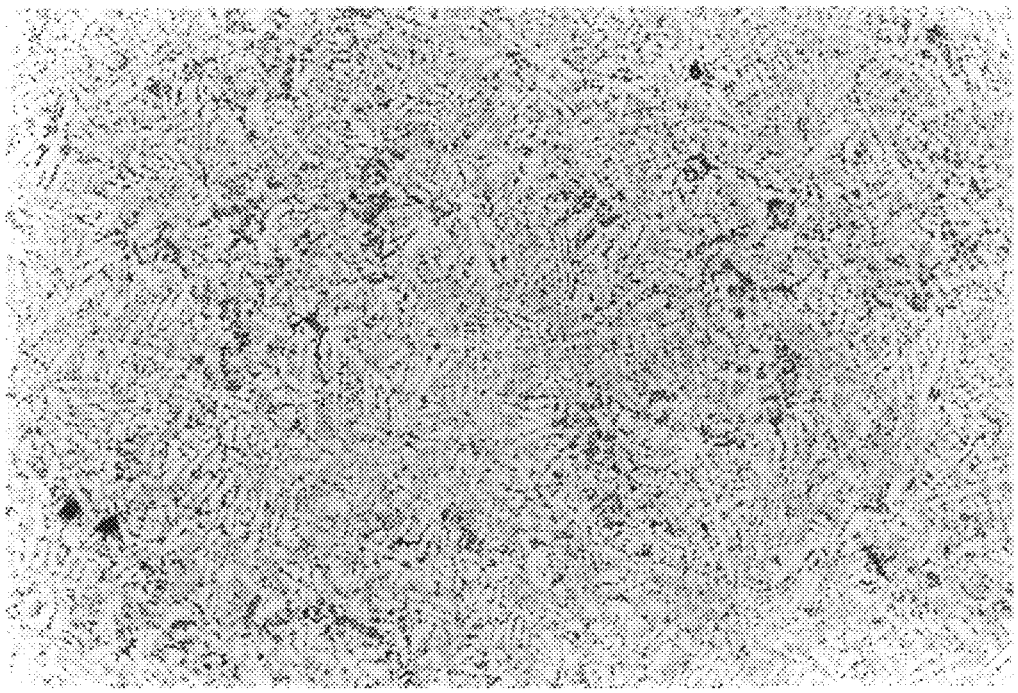
FIGS. 11 (*a*) and 11(*b*) are photographs for showing a structure in an embodiment 13.
Figure 11B:
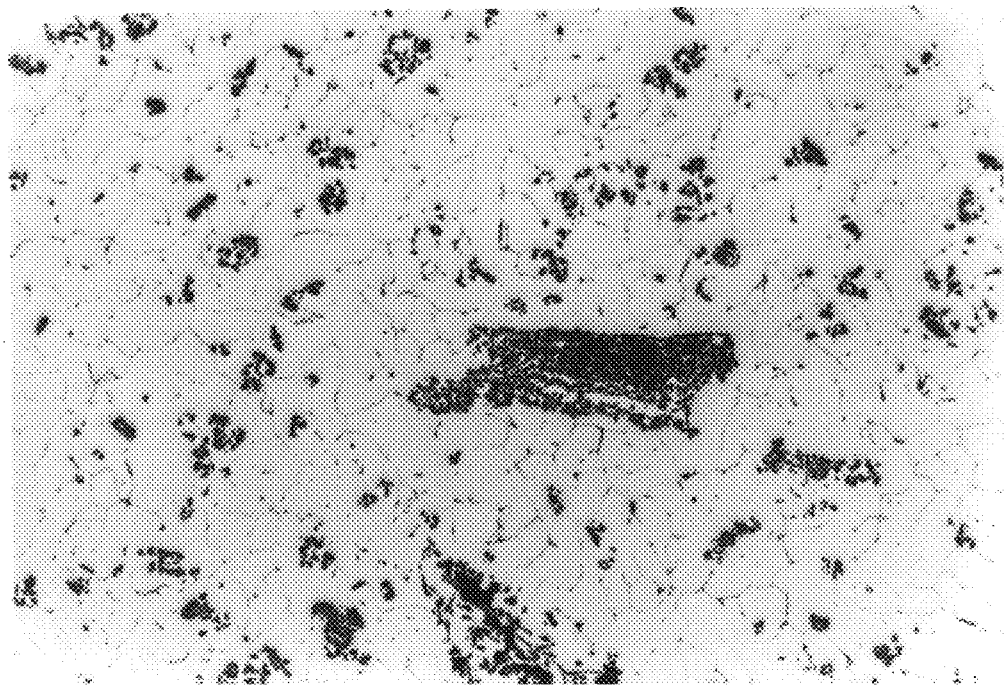

Then, tensile test pieces (JIS No.13, type B) were cut out of the plate having a hot rolled thickness of 20 mm, processed by an annealing process (at 345° C. for 2 hours), thereafter their strength at room temperature and elongation were measured by performing the tensile test in the same manner as that of the embodiment 1. In addition, these plates were casted again in the same manner as that of the embodiment 1, an availability or unavailability of recycling of scrap was checked, a volumetric rate of boron compound and a degree of cohesion of boron compound were checked by an X-ray diffraction and their structures were observed. All the obtained results are described in Table 28 and the photographs of representing structures are indicated in FIGS. 11(*a*) and 11(*b*). FIG. 11(*a*) indicates a photograph of No.163 of the example of the present invention and FIG. 11(*b*) indicates a photograph of No. 29 which is an example of comparison, respectively.

In reference to these results, it is possible to consider them as follows.

It has been found that all the pure Al type alloys satisfying all the requirements of the present invention were superior in strength and ductility, $AlB_2$ of 80% or more was present in them and there was no cohesion of boron compound. Further, it has been found that their hot rolling workability were also superior and recycling of scrap could be carried out. To the contrary, the alloys not satisfying the requirements of the present invention generated disadvantages of a reduction of neutron absorbing capacity, a poor ability in recycling of scrap caused by reduction in hot rolling workability.

Embodiment 14

The pure Al type alloys having compositions shown in Table 29 (the balances are Al) were applied to form blocks under the casting conditions in the embodiment 2. Since Nos.163 to 168 and 170 in the Table have the same composition as that of Table 27 and are processed by the same casting method as that of Table 27, the same numbers are applied.

Figure 12:
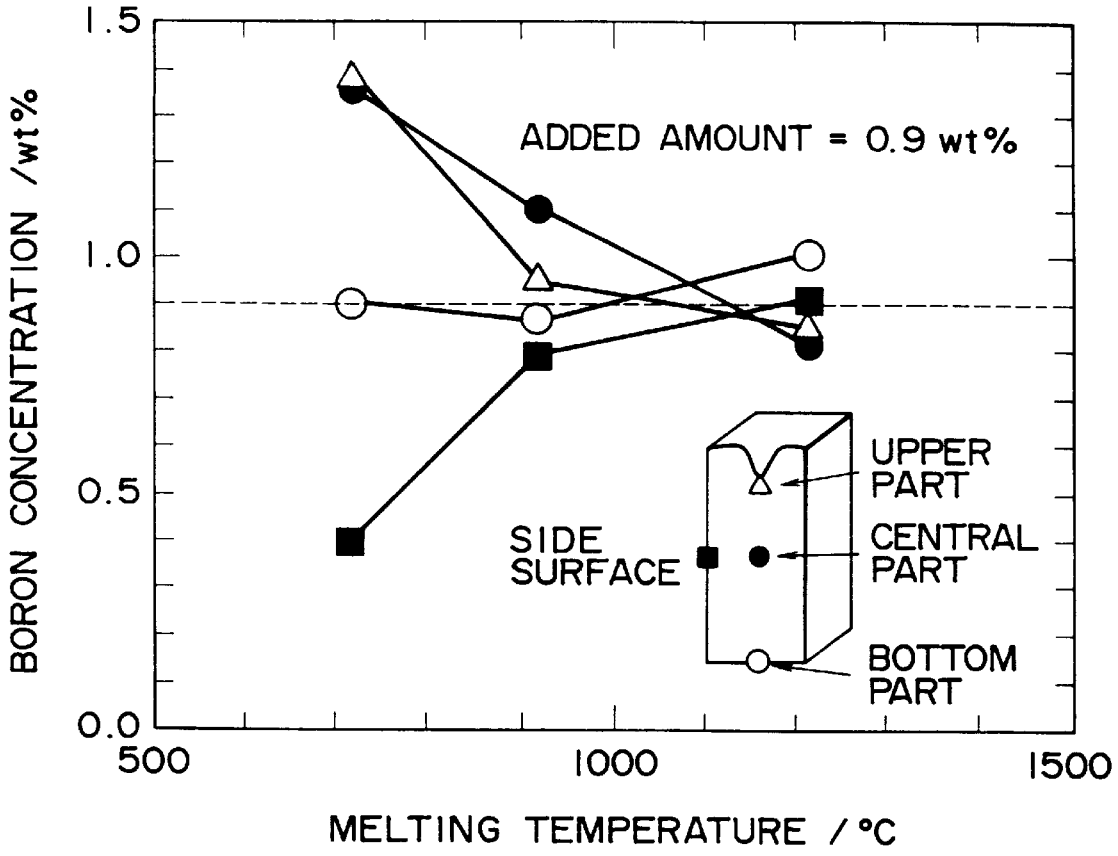
FIG. 12 is a graph for showing a relation between a melting temperature and a boron concentration in an embodiment 14.

As to the partial ingots (Nos.163, 164 and 177) obtained in this way, a segregation of boron in each of them was checked in the same manner as that of embodiment 2. The results are indicated in FIG. 12.

Then, a mode of boron compound, an availability or unavailability of recycling of scrap and a degree of segregation of boron for each of the ingots were checked in the same manner as that of the embodiment 3 and concurrently their structures were observed as well. All the results obtained are indicated in Table 30.

In reference to these results, it is possible to consider them as follows.

It has been found that all the pure Al type alloys obtained by the method of the present invention had no segregation of boron or no cohesion of boron compound and had $AlB_2$ of 80% or more, so that recycling of scrap could be carried out and further they were superior in strength and ductility as well.

To the contrary, the alloy not made by the method of the present invention showed a reduction in neutron absorbing capacity, a segregation of boron, a poor ability in recycling of scrap based on cohesion of boron compound and a reduction in strength.

Embodiment 15

Al—Mg—Zn type alloys having compositions shown in Table 31 (all the balances are Al) were applied, a pressure within the furnace was set as described in the Table and they were formed into blocks under the casting condition of A in the embodiment 1.

As to ingots obtained in this way, a concentration of residual hydrogen was measured in the same manner as that of the embodiment 5, and after each of the ingots was soaked in the same manner as that of the embodiment 1, a hot rolling was carried out, a degree of segregation of boron and a surface state of a rolled plate were evaluated. The obtained results are indicated in Table 32.

In reference to these results, it is possible to consider them as follows.

All Nos.184 to 189 and 191 are examples in which a concentration of residual hydrogen is controlled in a preferable range of the present invention by adjusting a pressure during a casting operation. However, it is apparent that a degree of segregation of boron is remarkably improved as compared with those of examples of the present invention (Nos.181 to 183) having no such control as above, and a surface state during a hot rolling operation is also superior.

Embodiment 16

Al—Cu type alloys having compositions shown in Table 33 (all the balances are Al) were applied, a pressure within the furnace was set as described in the Table and they were formed into blocks under the casting condition of A in the embodiment 1.

As to ingots obtained in this way, a concentration of residual hydrogen was measured in the same manner as that of the embodiment 5, and after each of the ingots was soaked in the same manner as that of the embodiment 1, a hot rolling was carried out, a degree of segregation of boron and a surface state of a rolled plate were evaluated in the same manner as that of the embodiment 5. The obtained results are indicated in Table 34.

In reference to these results, it is possible to consider them as follows.

All Nos.196 to 201 and 203 are examples in which a concentration of residual hydrogen is controlled in a preferable range of the present invention by adjusting a pressure during a casting operation. However, it is apparent that a degree of segregation of boron is remarkably improved as compared with those of examples of the present invention (Nos.193 to 195) having no such control as above, and a surface state during a hot rolling operation is also superior.

Embodiment 17

Al—Mn type alloys having compositions shown in Table 35 (all the balances are Al) were applied, a pressure within the furnace was set as described in the Table and they were formed into blocks under the casting condition of A in the embodiment 1.

As to ingots obtained in this way, a concentration of residual hydrogen was measured in the same manner as that of the embodiment 5, and after each of the ingots was soaked in the same manner as that of the embodiment 1, a hot rolling was carried out, a degree of segregation of boron and a surface state of a rolled plate were evaluated in the same manner as that of the embodiment 5. The obtained results are indicated in Table 36.

In reference to these results, it is possible to consider them as follows.

All Nos.208 to 213 and 215 are examples in which a concentration of residual hydrogen is controlled in a preferable range of the present invention by adjusting a pressure during a casting operation. However, it is apparent that a degree of segregation of boron is remarkably improved as compared with those of examples of the present invention (Nos.205 to 207) having no such control as above, and a surface state during a hot rolling operation is also superior.

Embodiment 18

Pure Al type alloys having compositions shown in Table 37 (all the balances are Al) were applied, a pressure within the furnace was set as described in the Table and they were formed into blocks under the casting condition of A in the embodiment 1.

As to ingots obtained in this way, a concentration of residual hydrogen was measured in the same manner as that of the embodiment 5, and after each of the ingots was soaked in the same manner as that of the embodiment 1, a hot rolling was carried out, a degree of segregation of boron and a surface state of a rolled plate were evaluated in the same manner as that of the embodiment 5. The obtained results are indicated in Table 38.

In reference to these results, it is possible to consider them as follows.

All Nos.220 to 225 and 227 are examples in which a concentration of residual hydrogen is controlled in a preferable range of the present invention by adjusting a pressure during a casting operation. However, it is apparent that a degree of segregation of boron is remarkably improved as compared with those of examples of the present invention (Nos.217 to 219) having no such control as above, and a surface state during a hot rolling operation is also superior.

Embodiment 19

Alloys having various compositions shown in Tables 39 to 44 (all balances are Al) were formed into blocks in the same manner as that of the embodiment 1 (as the casting condition, A was selected).

The ingots obtained in this way were soaked (at 490° C. for 24 hours), then they were hot rolled (temperature: 400° C., a total rolling reduction: 85%) and an availability or unavailability of the hot rolling characteristic was evaluated under the same standard as that of the embodiment 1.

Then, the tensile test plate pieces (JIS No.13, type B) were cut out of the plate having hot rolled thickness of 20 mm, then they were heat treated as follows in response to each of substances, a tensile test was carried out in the same manner as that of the embodiment 1, a strength at a room temperature as well as an elongation were measured.

Pure Al type alloy: Annealing treatment (processed at 345° C. for 2 hours, left and cooled)

Al—Mg—Si type alloy: T4 treatment (a solution heat-treatment at 530° C. and for 1 hour)

Al—Mg—Si type alloy: T6 treatment (a solution heat-treatment at 530° C., 1 hour and an aging treatment at 180° C., 24 hours )

Al—Cu type alloy: T6 treatment (a solution heat-treatment at 500° C., 1 hour and an aging treatment at 180° C., 10 hour)

Al—Mn type alloy: Annealing treatment (at 200° C., for 1 hour)

Al—Zn-Mg type alloy: T6 treatment (a solution heat-treatment at 480° C., for 1 hour and an aging treatment at 120° C. for 24 hours)

In addition, these plates were casted again in the same manner as that of the embodiment 1, an availability or unavailability of recycling of the scrap was checked and a volumetric rate of boron compound was checked with an X-ray diffraction. The obtained results are indicated for every substances in tables 45 to 50.

In reference to these results, it is possible to consider them as follows.

Each of the alloys satisfying all the requirements of the present invention was superior in strength and ductility, $AlB_2$ of 80% or more was present and no cohesion of boron compound was acknowledged. In addition, it was found that a hot rolling workability was superior and recycling of scrap was also possible.

To the contrary, the alloy not satisfying the requirements of the present invention had disadvantages of a reduction in a neutron absorbing capacity, a poor ability in recycling of scrap caused by reduction of a hot rolling workability and a reduction in strength and elongation.

TABLE 1

| No. | Casting Method | Chemical Composition (wt %) B | Mg | Cu | Mn | Cr | Zr | Zn | Ti | Remarks |
|---|---|---|---|---|---|---|---|---|---|---|
| 1 | A | 0.9 | 4.0 | | | | | | | Example of the Present Invention |
| 2 | B | 0.9 | 4.0 | | | | | | | Example of the Comparison |
| 3 | C | 0.9 | 4.0 | | | | | | | |
| 4 | X | 0.9 | 4.0 | | | | | | | |
| 5 | Y | 0.9 | 4.0 | | | | | | | Example of the Present Invention |
| 6 | Z | 0.9 | 4.0 | | | | | | | |
| 7 | A | 0.9 | 2.0 | 0.5 | 1.0 | | | | 0.3 | |
| 8 | A | 0.9 | 4.0 | | 0.5 | 0.4 | | 0.5 | | |
| 9 | A | 0.9 | 4.0 | | 0.2 | 0.2 | 0.05 | | 0.03 | |
| 10 | A | 1.1 | 8.0 | 0.6 | | | 0.3 | | | |
| 11 | A | 0.4 | 1.5 | | | | | | | Example of Comparison Example of Reference |
| 12 | A | 1.6 | 8.5 | | | | | | | |
| 13 | A | 0.9 | 4.0 | 0.7 | | | | | | |
| 14 | A | 0.9 | 4.0 | | 1.1 | | | | | |
| 15 | A | 0.9 | 4.0 | | | 0.5 | | | | |
| 16 | A | 0.9 | 4.0 | | | | 0.4 | | | |
| 17 | A | 0.9 | 4.0 | | | | | 0.6 | | |
| 18 | A | 0.9 | 4.0 | | | | | | 0.4 | |

TABLE 2

| No. | Strength (MPa) | Elongation (%) | Availability or Non-availability of Recycling of Scrap | $A1B_2$ (%) | Availability or Non-Availability of Hot Rolling Workability | Total Evaluation |
|---|---|---|---|---|---|---|
| 1 | 245 | 20 | Available | 90 | Available | ○ |
| 2 | 245 | 15 | Non-Available | 70 | Non-Available | X |
| 3 | 245 | 10 | Non-Available | 60 | Non-Available | X |
| 4 | 200 | 15 | Available | 80 | Available | X |
| 5 | 245 | 20 | Available | 95 | Available | ○ |
| 6 | 245 | 20 | Available | 95 | Available | ○ |
| 7 | 220 | 15 | Available | 80 | Available | ○ |
| 8 | 260 | 18 | Available | 85 | Available | ○ |
| 9 | 260 | 20 | Available | 80 | Available | ○ |

TABLE 2-continued

| No. | Strength (MPa) | Elongation (%) | Availability or Non-availability of Recycling of Scrap | $A1B_2$ (%) | Availability or Non-Availability of Hot Rolling Workability | Total Evaluation |
|---|---|---|---|---|---|---|
| 10 | 300 | 18 | Available | 90 | Available | ○ |
| 11 | 180 | 20 | Available | 80 | Available | X |
| 12 | 280 | 5 | Non-Available | 60 | Non-Available | X |
| 13 | 320 | 6 | Available | 80 | Available | Δ |
| 14 | 320 | 8 | Available | 90 | Available | Δ |
| 15 | 310 | 7 | Available | 90 | Available | Δ |
| 16 | 300 | 7 | Available | 90 | Available | Δ |
| 17 | 280 | 5 | Available | 80 | Available | Δ |
| 18 | 290 | 5 | Available | 85 | Available | Δ |

TABLE 3

| No. | Casting Method | Chemical Composition (wt %) B | Mg | Cu | Mn | Cr | Zr | Zn | Ti | Remarks |
|---|---|---|---|---|---|---|---|---|---|---|
| 1 | A | 0.9 | 4.0 | | | | | | | Example of the Present Invention |
| 19 | D | 0.9 | 4.0 | | | | | | | |
| 2 | B | 0.9 | 4.0 | | | | | | | Example of Comparison |
| 3 | C | 0.9 | 4.0 | | | | | | | |
| 4 | X | 0.9 | 4.0 | | | | | | | |
| 5 | Y | 0.9 | 4.0 | | | | | | | Example of the Present Invention |
| 6 | Z | 0.9 | 4.0 | | | | | | | |
| 20 | A | 0.9 | 4.0 | 0.5 | 0.1 | | | 0.5 | 0.03 | |
| 21 | D | 0.9 | 4.0 | 0.5 | 0.1 | | | 0.5 | 0.03 | |
| 22 | B | 0.9 | 4.0 | 0.5 | 0.1 | | | 0.5 | 0.03 | Example of Comparison |
| 23 | C | 0.9 | 4.0 | 0.5 | 0.1 | | | 0.5 | 0.03 | |
| 24 | A | 0.9 | 8.0 | | | 0.1 | 0.05 | | | Example of the Present Invention |
| 25 | D | 0.9 | 2.0 | | | 0.1 | 0.05 | | | |
| 26 | B | 0.9 | 8.0 | | | 0.1 | 0.05 | | | Example of Comparison |
| 27 | C | 0.9 | 2.0 | | | 0.1 | 0.05 | | | |

TABLE 4

| No. | Strength (MPa) | Elongation (%) | Segregation of boron | Availability or Non-Availability of Recycling of Scrap | State of Boron Compound | Total Evaluation |
|---|---|---|---|---|---|---|
| 1 | 245 | 20 | None | Available | $A1B_2$ 80% or more No Cohesion | ○ |
| 19 | 245 | 20 | None | Available | $A1B_2$ 80% or more No Cohesion | ○ |
| 2 | 245 | 15 | Presence | Non-Available | $A1B_2$ 80% or less, Cohesion | X |
| 3 | 245 | 10 | Presence | Non-Available | $A1B_2$ 80% or less, Cohesion | X |
| 4 | 200 | 15 | None | Available | $A1B_2$ 80% or more, No Cohesion | X |
| 5 | 245 | 20 | None | Available | $A1B_2$ 80% or more, No Cohesion | ○ |
| 6 | 245 | 20 | None | Available | $A1B_2$ 80% or more, No Cohesion | ○ |
| 20 | 280 | 18 | None | Available | $A1B_2$ 80% or more, No Cohesion | ○ |
| 21 | 280 | 18 | None | Available | $A1B_2$ 80% or more, No Cohesion | ○ |

TABLE 4-continued

| No. | Strength (MPa) | Elongation (%) | Segregation of boron | Availability or Non-Availability of Recycling of Scrap | State of Boron Compound | Total Evaluation |
|---|---|---|---|---|---|---|
| 22 | 280 | 8 | Presence | Non-Available | $A1B_2$ 80% or less, Cohesion | X |
| 23 | 280 | 7 | Presence | Non-Available | $A1B_2$ 80% or less, Cohesion | X |
| 24 | 280 | 18 | None | Available | $A1B_2$ 80% or more, No Cohesion | ○ |
| 25 | 280 | 18 | None | Available | $A1B_2$ 80% or more, No Cohesion | ○ |
| 26 | 280 | 8 | Presence | Non-Available | $A1B_2$ 80% or less, Cohesion | X |
| 27 | 280 | 7 | Presence | Non-Available | $A1B_2$ 80% or less, Cohesion | X |

TABLE 5

| | Casting | Chemical Composition (wt %) | | | | | | | | | |
|---|---|---|---|---|---|---|---|---|---|---|---|
| No. | Method | B | Mg | Si | Cu | Mn | Cr | Zr | Zn | Ti | Remarks |
| 28 | A | 0.9 | 1.0 | 0.7 | | | | | | | Example of the Present Invention |
| 29 | B | 0.9 | 1.0 | 0.7 | | | | | | | Example of Comparison |
| 30 | C | 0.9 | 1.0 | 0.7 | | | | | | | |
| 31 | X | 0.9 | 1.0 | 0.7 | | | | | | | |
| 32 | Y | 0.9 | 1.0 | 0.7 | | | | | | | Example of the Present Invention |
| 33 | Z | 0.9 | 1.0 | 0.7 | | | | | | | |
| 34 | A | 0.9 | 0.4 | 0.4 | 0.3 | 1.0 | | | | 0.3 | |
| 35 | A | 0.9 | 1.0 | 0.7 | | 0.5 | 0.4 | | 0.3 | | |
| 36 | A | 0.9 | 1.0 | 0.7 | | 0.2 | 0.2 | 0.1 | | 0.03 | |
| 37 | A | 1.1 | 1.5 | 1.5 | 0.6 | | | 0.3 | | | |
| 38 | A | 0.4 | 0.2 | 1.5 | | | | | | | Example of Comparison |
| 39 | A | 1.6 | 1.6 | 1.5 | | | | | | | |
| 40 | A | 0.9 | 1.0 | 0.2 | | | | | | | |
| 41 | A | 0.9 | 1.0 | 1.6 | | | | | | | |
| 42 | A | 0.9 | 1.0 | 0.7 | 0.7 | | | | | | Example of Reference |
| 43 | A | 0.9 | 1.0 | 0.7 | | 1.1 | | | | | |
| 44 | A | 0.9 | 1.0 | 0.7 | | | 0.5 | | | | |
| 45 | A | 0.9 | 1.0 | 0.7 | | | | 0.4 | | | |
| 46 | A | 0.9 | 1.0 | 0.7 | | | | | 0.6 | | |
| 47 | A | 0.9 | 1.0 | 0.7 | | | | | | 0.4 | |

TABLE 6

| No. | Strength (MPa) | Elongation (%) | Availability or Non-Availability of Recycling of Scrap | $A1B_2$ (%) | Availability or Non-Availability of Hot Rolling Workability | Total Evaluation |
|---|---|---|---|---|---|---|
| 28 | 270 | 12 | Available | 90 | Available | ○ |
| 29 | 270 | 8 | Non-Available | 70 | Non-Available | X |
| 30 | 270 | 4 | Non-Available | 60 | Non-Available | X |
| 31 | 200 | 12 | Available | 90 | Available | X |
| 32 | 270 | 12 | Available | 95 | Available | ○ |
| 33 | 270 | 12 | Available | 95 | Available | ○ |
| 34 | 240 | 9 | Available | 80 | Available | ○ |
| 35 | 280 | 10 | Available | 85 | Available | ○ |
| 36 | 280 | 12 | Available | 80 | Available | ○ |
| 37 | 320 | 10 | Available | 90 | Available | ○ |
| 38 | 200 | 12 | Available | 80 | Available | X |
| 39 | 300 | 3 | Non-Available | 60 | Non-Available | X |

TABLE 6-continued

| No. | Strength (MPa) | Elongation (%) | Availability or Non-Availability of Recycling of Scrap | $A1B_2$ (%) | Availability or Non-Availability of Hot Rolling Workability | Total Evaluation |
|---|---|---|---|---|---|---|
| 40 | 200 | 12 | Available | 85 | Available | X |
| 41 | 260 | 3 | Non-Available | 60 | Non-Available | X |
| 42 | 340 | 2 | Available | 80 | Available | Δ |
| 43 | 340 | 4 | Available | 90 | Available | Δ |
| 44 | 330 | 3 | Available | 90 | Available | Δ |
| 45 | 320 | 3 | Available | 90 | Available | Δ |
| 46 | 300 | 5 | Available | 80 | Available | Δ |
| 47 | 310 | 1 | Available | 85 | Available | Δ |

TABLE 7

| | Casting | Chemical Composition (wt %) | | | | | | | | | |
|---|---|---|---|---|---|---|---|---|---|---|---|
| No. | Method | B | Mg | Si | Cu | Mn | Cr | Zr | Zn | Ti | Results |
| 28 | A | 0.9 | 1.0 | 0.7 | | | | | | | Example of the Present Invention |
| 48 | D | 0.9 | 1.0 | 0.7 | | | | | | | |
| 29 | B | 0.9 | 1.0 | 0.7 | | | | | | | Example of Comparison |
| 30 | C | 0.9 | 1.0 | 0.7 | | | | | | | |
| 31 | X | 0.9 | 1.0 | 0.7 | | | | | | | |
| 32 | Y | 0.9 | 1.0 | 0.7 | | | | | | | Example of the Present Invention |
| 33 | Z | 0.9 | 1.0 | 0.7 | | | | | | | |
| 49 | A | 0.9 | 1.0 | 0.7 | 0.6 | 1.0 | | | 0.3 | 0.3 | |
| 50 | D | 0.9 | 1.0 | 0.7 | 0.6 | 1.0 | | | 0.3 | 0.3 | |
| 51 | B | 0.9 | 1.0 | 0.7 | 0.6 | 1.0 | | | 0.3 | 0.3 | Example of Comparison |
| 52 | C | 0.9 | 1.0 | 0.7 | 0.6 | 1.0 | | | 0.3 | 0.3 | |
| 53 | A | 0.9 | 1.5 | 0.3 | | | 0.4 | 0.3 | | | Example of the Present Invention |
| 54 | D | 0.9 | 0.3 | 1.5 | | | 0.4 | 0.3 | | | |
| 55 | B | 0.9 | 1.5 | 0.3 | | | 0.4 | 0.3 | | | Example of Comparison |
| 56 | C | 0.9 | 0.3 | 1.5 | | | 0.4 | 0.3 | | | |

TABLE 8

| No. | Strength (MPa) | Elongation (%) | Segregation of boron | Availability or Non-Availability of Recycling of Scrap | State of Boron Compound | Total Evaluation |
|---|---|---|---|---|---|---|
| 28 | 270 | 12 | None | Available | $A1B_2$ 80% or more No Cohesion | ○ |
| 48 | 270 | 12 | None | Available | $A1B_2$ 80% or more, No Cohesion | ○ |
| 29 | 270 | 8 | Presence | Non-Available | $A1B_2$ 80% or less, Cohesion | X |
| 30 | 270 | 4 | Presence | Non-Available | $A1B_2$ 80% or less, Cohesion | X |
| 31 | 200 | 12 | None | Available | $A1B_2$ 80% or more, Cohesion | X |
| 32 | 270 | 12 | None | Available | $A1B_2$ 80% or more, No Cohesion | ○ |
| 33 | 270 | 12 | None | Available | $A1B_2$ 80% or more, No Cohesion | ○ |
| 49 | 300 | 12 | None | Available | $A1B_2$ 80% or more, No Cohesion | ○ |
| 50 | 300 | 12 | None | Available | $A1B_2$ 80% or more, No Cohesion | ○ |
| 51 | 300 | 4 | Presence | Non-Available | $A1B_2$ 80% or less, Cohesion | X |
| 52 | 300 | 3 | Presence | Non-Available | $A1B_2$ 80% or less, Cohesion | X |
| 53 | 300 | 12 | None | Available | $A1B_2$ 80% or more, No Cohesion | ○ |
| 54 | 300 | 12 | None | Available | $A1B_2$ 80% or more, No Cohesion | ○ |
| 55 | 300 | 4 | Presence | Non-Available | $A1B_2$ 80% or less, Cohesion | X |
| 56 | 300 | 4 | Presence | Non-Available | $A1B_2$ 80% or less, Cohesion | X |

TABLE 9

| | Casting | Chemical Composition (wt %) | | | | | | | | | | Pressure in the Furnace | |
|---|---|---|---|---|---|---|---|---|---|---|---|---|---|
| No. | Method | B | Mg | Fe | Si | Cu | Mn | Cr | Zr | Zn | Ti | (Torr) | Remarks |
| 57 | A | 0.9 | 4.0 | | | | | | | | | 760 | Example of |
| 58 | A | 0.9 | 4.0 | | | | | | | | | 600 | the Present |
| 59 | A | 0.9 | 4.0 | | | | | | | | | 550 | Invention |
| 60 | A | 0.9 | 4.0 | | | | | | | | | 500 | Example of |
| 61 | A | 0.9 | 4.0 | | | | | | | | | 450 | the Present |
| 62 | A | 0.9 | 4.0 | | | | | | | | | 300 | Invention |
| 63 | A | 0.9 | 4.0 | | | 0.5 | 0.1 | | | 0.5 | 0.3 | 300 | |
| 64 | A | 0.9 | 4.0 | | | | | 0.1 | 0.05 | | | 300 | |
| 65 | A | 0.9 | 4.0 | 0.4 | 0.1 | 0.5 | 0.1 | 0.1 | 0.05 | 0.3 | 0.03 | 300 | |
| 66 | A | 0.4 | 4.0 | | | | | | | | | 300 | Example of Comparison |
| 67 | A | 0.5 | 4.0 | | | | | | | | | 300 | Example of the Present Invention |
| 68 | A | 1.6 | 4.0 | | | | | | | | | 300 | Example of Comparison |

TABLE 10

| No. | Casting Method | Chemical Composition (wt %) B | Mg | Si | Fe | Cu | Mn | Cr | Zr | Zn | Ti | Pressure in the Furnace (Torr) | Remarks |
|---|---|---|---|---|---|---|---|---|---|---|---|---|---|
| 69 | A | 0.9 | 1.0 | 0.7 | | | | | | | | 760 | Example of the Present Invention |
| 70 | A | 0.9 | 1.0 | 0.7 | | | | | | | | 600 | |
| 71 | A | 0.9 | 1.0 | 0.7 | | | | | | | | 550 | |
| 72 | A | 0.9 | 1.0 | 0.7 | | | | | | | | 500 | Example of the Present Invention |
| 73 | A | 0.9 | 1.0 | 0.7 | | | | | | | | 450 | |
| 74 | A | 0.9 | 1.0 | 0.7 | | | | | | | | 300 | |
| 75 | A | 0.9 | 1.0 | 0.7 | | 0.6 | 1.0 | | | 0.3 | 0.3 | 300 | |
| 76 | A | 0.9 | 1.0 | 0.7 | | | | 0.4 | 0.3 | | | 300 | |
| 77 | A | 0.9 | 1.0 | 0.7 | 0.4 | 0.6 | 1.0 | 0.3 | 0.05 | 0.3 | 0.3 | 300 | |
| 78 | A | 0.4 | 1.0 | 0.7 | | | | | | | | 300 | Example of Comparison |
| 79 | A | 0.5 | 1.0 | 0.7 | | | | | | | | 300 | Example of the Present Invention |
| 80 | A | 1.6 | 1.0 | 0.7 | | | | | | | | 300 | Example of Comparison |

TABLE 11

| No. | Segregation of Boron | Hydrogen Concentration (ppm) | Surface State of Rolled Plate | Total Evaluation |
|---|---|---|---|---|
| 57 | ○ | 4.27 | X | Δ |
| 58 | ○ | 2.10 | X | Δ |
| 59 | ○ | 1.23 | X | Δ |
| 60 | ◎ | 0.50 | ◎ | ◎ |
| 61 | ◎ | 0.53 | ◎ | ◎ |
| 62 | ◎ | 0.46 | ◎ | ◎ |
| 63 | ◎ | 0.40 | ◎ | ◎ |
| 64 | ◎ | 0.43 | ◎ | ◎ |
| 65 | ◎ | 0.42 | ◎ | ◎ |
| 66 | ◎ | 0.40 | ◎ | X |
| 67 | ◎ | 0.41 | ◎ | ○ |
| 68 | ◎ | 0.46 | ◎ | X |

TABLE 12

| No. | Segregation of Boron | Hydrogen Concentration (ppm) | Surface State of Rolled Plate | Total Evaluation |
|---|---|---|---|---|
| 69 | ○ | 3.70 | X | Δ |
| 70 | ○ | 2.50 | X | Δ |
| 71 | ○ | 1.10 | X | Δ |
| 72 | ◎ | 0.49 | ○ | ○ |
| 73 | ◎ | 0.51 | ○ | ○ |
| 74 | ◎ | 0.38 | ◎ | ◎ |
| 75 | ◎ | 0.45 | ◎ | ◎ |
| 76 | ◎ | 0.39 | ◎ | ◎ |
| 77 | ◎ | 0.43 | ◎ | ◎ |
| 78 | ◎ | 0.42 | ◎ | X |
| 79 | ◎ | 0.40 | ◎ | ○ |
| 80 | ◎ | 0.45 | ◎ | X |

TABLE 13

| Portions of Ingot | No. 57 | Total Evaluation |
|---|---|---|
| Upper Part | 1.46 | 0.82 |
| Central Part | 0.81 | 0.85 |
| Bottom Part | 0.58 | 0.94 |
| Side Surface | 0.71 | 0.79 |

TABLE 14

| No. | Casting Method | Chemical Composition (wt %) B | Mg | Zn | Cu | Mn | Cr | Zr | Ti | Remarks |
|---|---|---|---|---|---|---|---|---|---|---|
| 81 | A | 0.9 | 2.5 | 6.0 | | | | | | Example of the Present Invention |
| 82 | B | 0.9 | 2.5 | 6.0 | | | | | | Example of Comparison |
| 83 | C | 0.9 | 2.5 | 6.0 | | | | | | |
| 84 | X | 0.9 | 2.5 | 6.0 | | | | | | |
| 85 | Y | 0.9 | 2.5 | 6.0 | | | | | | Example of the Present Invention |
| 86 | Z | 0.9 | 2.5 | 6.0 | | | | | | |
| 87 | A | 0.9 | 1.1 | 1.0 | 1.5 | 1.0 | | | 0.3 | |
| 88 | A | 0.9 | 2.5 | 6.0 | | 0.5 | 0.2 | | | |
| 89 | A | 0.9 | 2.5 | 6.0 | | 0.2 | 0.1 | 0.1 | 0.03 | |
| 90 | A | 1.1 | 2.5 | 7.0 | 2.5 | | | 0.3 | | |
| 91 | A | 0.4 | 0.9 | 7.0 | | | | | | Example of Comparison |
| 92 | A | 1.6 | 4.5 | 7.0 | | | | | | |
| 93 | A | 0.9 | 2.5 | 0.7 | | | | | | |
| 94 | A | 0.9 | 2.5 | 8.5 | | | | | | |
| 95 | A | 0.9 | 2.5 | 6.0 | 3.1 | | | | | Example of Reference |
| 96 | A | 0.9 | 2.5 | 6.0 | | 1.1 | | | | |
| 97 | A | 0.9 | 2.5 | 6.0 | | | 0.5 | | | |
| 98 | A | 0.9 | 2.5 | 6.0 | | | | 0.4 | | |
| 99 | A | 0.9 | 2.5 | 6.0 | | | | | 0.4 | |

TABLE 15

| No. | Strength (MPa) | Elon-gation (%) | Availability or Non-Availability of Recycling of Scrap | $A1B_2$ (%) | Availability or Non-Availability of Hot Rolling Workability | Total Evaluation |
|---|---|---|---|---|---|---|
| 81 | 500 | 11 | Available | 90 | Available | ○ |
| 82 | 500 | 5 | Non-Available | 70 | Non-Available | X |
| 83 | 500 | 6 | Non-Available | 60 | Non-Available | X |
| 84 | 450 | 10 | Available | 80 | Available | X (Adjustment of Mg component is difficult) |
| 85 | 505 | 11 | Available | 85 | Available | ○ |
| 86 | 508 | 10 | Available | 80 | Available | ○ |
| 87 | 540 | 9 | Available | 90 | Available | ○ |
| 88 | 520 | 10 | Available | 80 | Available | ○ |
| 89 | 525 | 9 | Available | 80 | Available | ○ |
| 90 | 530 | 9 | Available | 80 | Available | ○ |
| 91 | 530 | 9 | Available | 90 | Available | X (Neutron Absorbing Capacity) |
| 92 | 510 | 5 | Available | 90 | Non-Available | X (Coarse Compound) |
| 93 | 250 | 7 | Available | 90 | Available | X (Not contributed to hardening) |
| 94 | 480 | 5 | Available | 80 | Non-Available | X (Coarse Compound) |
| 95 | 490 | 5 | Available | 85 | Available | Δ |
| 96 | 490 | 6 | Available | 90 | Available | Δ |
| 97 | 490 | 7 | Available | 85 | Available | Δ |
| 98 | 490 | 5 | Available | 85 | Available | Δ |
| 99 | 490 | 6 | Available | 80 | Available | Δ |

TABLE 16

| Casting | | Chemical Composition (wt %) | | | | | | | | |
|---|---|---|---|---|---|---|---|---|---|---|
| No. | Method | B | Mg | Zn | Cu | Mn | Cr | Zr | Ti | Remarks |
| 81 | A | 0.9 | 2.5 | 6.0 | | | | | | Example of |
| 100 | D | 0.9 | 2.5 | 6.0 | | | | | | the Present |
| | | | | | | | | | | Invention |
| 82 | B | 0.9 | 2.5 | 6.0 | | | | | | Example of |
| 83 | C | 0.9 | 2.5 | 6.0 | | | | | | Comparison |
| 84 | X | 0.9 | 2.5 | 6.0 | | | | | | |
| 85 | Y | 0.9 | 2.5 | 6.0 | | | | | | Example of |
| 86 | Z | 0.9 | 2.5 | 6.0 | | | | | | the Present |

TABLE 16-continued

| Casting | | Chemical Composition (wt %) | | | | | | | | |
|---|---|---|---|---|---|---|---|---|---|---|
| No. | Method | B | Mg | Zn | Cu | Mn | Cr | Zr | Ti | Remarks |
| 101 | A | 0.9 | 2.5 | 6.0 | 1.5 | 1.0 | | | 0.03 | Invention |
| 102 | D | 0.9 | 2.5 | 6.0 | 1.5 | 1.0 | | | 0.03 | |
| 103 | B | 0.9 | 2.5 | 6.0 | 1.5 | 1.0 | | | 0.03 | Example of |
| 104 | C | 0.9 | 2.5 | 6.0 | 1.5 | 1.0 | | | 0.03 | Comparison |
| 105 | A | 0.9 | 4.0 | 0.8 | | | 0.3 | 0.3 | | Example of |
| 106 | D | 0.9 | 1.0 | 8.0 | | | 0.3 | 0.3 | | the Present |
| | | | | | | | | | | Invention |
| 107 | B | 0.9 | 4.0 | 0.8 | | | 0.3 | 0.3 | | Example of |
| 108 | C | 0.9 | 1.0 | 8.0 | | | 0.3 | 0.3 | | Reference |

TABLE 17

| No. | Strength (MPa) | Elonga-tion (%) | Segrega-tion of boron | Availability or Non-Availability of Recycling of Scrap | State of Boron Compound | Total Evalua-tion |
|---|---|---|---|---|---|---|
| 81 | 500 | 11 | None | Available | $A1B_2$ 80% or more No Cohesion | ○ |
| 100 | 500 | 9 | None | Available | $A1B_2$ 80% or more No Cohesion | ○ |
| 82 | 500 | 5 | Presence | Non-Available | $A1B_2$ 80% or less, Cohesion | X |
| 83 | 500 | 6 | Presence | Non-Available | $A1B_2$ 80% or less, Cohesion | X |
| 84 | 450 | 10 | None | Available | $A1B_2$ 80% or more, | X (Mg is |

TABLE 17-continued

| No. | Strength (MPa) | Elongation (%) | Segregation of boron | Availability or Non-Availability of Recycling of Scrap | State of Boron Compound | Total Evaluation |
|---|---|---|---|---|---|---|
| | | | | | No Cohesion | adjusted) |
| 35 | 510 | 11 | None | Available | $A1B_2$ 80% or more, No Cohesion | ○ |
| 36 | 525 | 12 | None | Available | $A1B_2$ 80% or more, No Cohesion | ○ |
| 101 | 540 | 10 | None | Available | $A1B_2$ 80% or more, No Cohesion | ○ |
| 102 | 515 | 9 | None | Available | $A1B_2$ 80% or more, No Cohesion | ○ |
| 103 | 490 | 6 | Presence | Non-Available | $A1B_2$ 80% or less, Cohesion | X |
| 104 | 480 | 8 | Presence | Non-Available | $A1B_2$ 80% or less, Cohesion | X |
| 105 | 510 | 9 | None | Available | $A1B_2$ 80% or more, No Cohesion | ○ |
| 106 | 520 | 10 | None | Available | $A1B_2$ 80% or more, No Cohesion | ○ |
| 107 | 385 | 5 | Presence | Non-Available | $A1B_2$ 80% or less, Cohesion | X |
| 108 | 390 | 5 | Presence | Non-Available | $A1B_2$ 80% or less, Cohesion | X |

TABLE 18

| No. | Age Hardening Heat Treatment | Strength (MPa) | Evaluation |
|---|---|---|---|
| 81 | Present | 500 | ○ |
| 81 | Non-Present | 220 | X |

TABLE 19

| | Casting | Chemical Composition (wt %) | | | | | | | | |
|---|---|---|---|---|---|---|---|---|---|---|
| No. | Method | B | Cu | Mg | Mn | Cr | Zr | Zn | Ti | Remarks |
| 109 | A | 0.9 | 4.5 | | | | | | | Example of the Present Invention |
| 110 | B | 0.9 | 4.5 | | | | | | | Example of Comparison |
| 111 | C | 0.9 | 4.5 | | | | | | | |
| 112 | X | 0.9 | 4.5 | | | | | | | |
| 113 | Y | 0.9 | 4.5 | | | | | | | Example of the Present Invention |
| 114 | Z | 0.9 | 4.5 | | | | | | | |
| 115 | A | 0.9 | 1.5 | 1.8 | 1.2 | | | | 0.3 | |
| 116 | A | 0.9 | 4.5 | | 0.5 | 0.4 | | 0.5 | | |

TABLE 19-continued

| | Casting | Chemical Composition (wt %) | | | | | | | | |
|---|---|---|---|---|---|---|---|---|---|---|
| No. | Method | B | Cu | Mg | Mn | Cr | Zr | Zn | Ti | Remarks |
| 117 | A | 0.9 | 4.5 | | 0.2 | 0.2 | 0.05 | | 0.03 | |
| 118 | A | 1.1 | 7.0 | 1.0 | | | 0.3 | | | |
| 119 | A | 0.4 | 1.0 | | | | | | | Example of |
| 120 | A | 1.6 | 7.5 | | | | | | | Comparison |
| 121 | A | 0.9 | 4.5 | 1.9 | | | | | | Example of |
| 122 | A | 0.9 | 4.5 | | 1.3 | | | | | Reference |
| 123 | | 0.9 | 4.5 | | | 0.5 | | | | |
| 124 | A | 0.9 | 4.5 | | | | 0.4 | | | |
| 125 | A | 0.9 | 4.5 | | | | | 0.6 | | |
| 126 | A | 0.9 | 4.5 | | | | | | 0.4 | |

TABLE 20

| No. | Strength (MPa) | Elongation (%) | Availability or Non-Availability of Recycling of Scrap | $A1B_2$ (%) | Availability or Non-Availability of Hot Rolling Workability | Total Evaluation |
|---|---|---|---|---|---|---|
| 109 | 370 | 15 | Available | 90 | Available | ○ |
| 110 | 370 | 8 | Non-Available | 70 | Non-Available | X |
| 111 | 370 | 7 | Non-Available | 60 | Non-Available | X |
| 112 | 370 | 4 | Available | 80 | Available | X (Gas is mixed) |
| 113 | 380 | 11 | Available | 85 | Available | ○ |
| 114 | 375 | 12 | Available | 80 | Available | ○ |
| 115 | 440 | 10 | Available | 90 | Available | ○ |
| 116 | 470 | 11 | Available | 80 | Available | ○ |
| 117 | 470 | 10 | Available | 80 | Available | ○ |

TABLE 20-continued

| No. | Strength (MPa) | Elongation (%) | Availability or Non-Availability of Recycling of Scrap | $A1B_2$ (%) | Availability or Non-Availability of Hot Rolling Workability | Total Evaluation |
|---|---|---|---|---|---|---|
| 118 | 480 | 10 | Available | 80 | Available | ○ |
| 119 | 350 | 9 | Available | 90 | Available | X (Neutron Absorbing Capacity) |
| 120 | 390 | 5 | Available | 90 | Non-Available | X (Coarse Compound) |
| 121 | 400 | 5 | Available | 80 | Available | Δ |
| 122 | 400 | 6 | Available | 85 | Available | Δ |
| 123 | 400 | 7 | Available | 90 | Available | Δ |
| 124 | 400 | 8 | Available | 85 | Available | Δ |
| 125 | 400 | 6 | Available | 85 | Available | Δ |
| 126 | 400 | 7 | Available | 80 | Available | Δ |

TABLE 21

| | Casting | Chemical Composition (wt %) | | | | | | | | |
|---|---|---|---|---|---|---|---|---|---|---|
| No. | Method | B | Cu | Mg | Mn | Cr | Zr | Zn | Ti | Remarks |
| 109 | A | 0.9 | 4.5 | | | | | | | Example of the Present Invention |
| 127 | D | 0.9 | 4.5 | | | | | | | |
| 110 | B | 0.9 | 4.5 | | | | | | | Example of Comparison |
| 111 | C | 0.9 | 4.5 | | | | | | | |
| 112 | X | 0.9 | 4.5 | | | | | | | Example of the Present |
| 113 | Y | 0.9 | 4.5 | | | | | | | |
| 114 | Z | 0.9 | 4.5 | | | | | | | |

TABLE 21-continued

| | Casting | Chemical Composition (wt %) | | | | | | | | |
|---|---|---|---|---|---|---|---|---|---|---|
| No. | Method | B | Cu | Mg | Mn | Cr | Zr | Zn | Ti | Remarks |
| 128 | A | 0.9 | 4.5 | | | 0.1 | 0.05 | | | Invention |
| 129 | D | 0.9 | 4.5 | | | 0.1 | 0.05 | | | |
| 130 | B | 0.9 | 4.5 | | | 0.1 | 0.05 | | | Example of Comparison |
| 131 | C | 0.9 | 4.5 | | | 0.1 | 0.05 | | | |
| 132 | A | 0.9 | 7.0 | 1.5 | 0.3 | | | 0.5 | 0.03 | Example of the Present Invention |
| 133 | D | 0.9 | 1.5 | 1.5 | 0.3 | | | 0.5 | 0.03 | |
| 134 | B | 0.9 | 7.0 | 1.5 | 0.3 | | | 0.5 | 0.03 | Example of Reference |
| 135 | C | 0.9 | 1.5 | 1.5 | 0.3 | | | 0.5 | 0.03 | |

TABLE 22

| No. | Strength (MPa) | Elongation (%) | Segregation of Boron | Availability or Non-Availability of Recycling of Scrap | State of Boron Compound | Total Evaluation |
|---|---|---|---|---|---|---|
| 109 | 370 | 11 | None | Available | $A1B_2$ 80% or more No Cohesion | ○ |
| 127 | 370 | 15 | None | Available | $A1B_2$ 80% or more No Cohesion | ○ |
| 110 | 370 | 5 | Presence | Non-Available | $A1B_2$ 80% or less, Cohesion | X |
| 111 | 370 | 6 | Presence | Non-Available | $A1B_2$ 80% or less, Cohesion | X |
| 112 | 350 | 4 | None | Available | $A1B_2$ 80% or more, No Cohesion | X (Gas is mixed) |
| 113 | 380 | 11 | None | Available | $A1B_2$ 80% or more, No Cohesion | ○ |
| 114 | 375 | 12 | None | Available | $A1B_2$ 80% or more, No Cohesion | ○ |
| 128 | 470 | 10 | None | Available | $A1B_2$ 80% or more, No Cohesion | ○ |
| 129 | 470 | 10 | None | Available | $A1B_2$ 80% or more, No Cohesion | ○ |
| 130 | 470 | 5 | Presence | Non-Available | $A1B_2$ 80% or less, Cohesion | X |
| 131 | 470 | 6 | Presence | Non-Available | $A1B_2$ 80% or less, Cohesion | X |
| 132 | 500 | 10 | None | Available | $A1B_2$ 80% or more, No Cohesion | ○ |

TABLE 22-continued

| No. | Strength (MPa) | Elongation (%) | Segregation of Boron | Availability or Non-Availability of Recycling of Scrap | State of Boron Compound | Total Evaluation |
|---|---|---|---|---|---|---|
| 133 | 470 | 12 | None | Available | $A1B_2$ 80% or more, No Cohesion | ○ |
| 134 | 500 | 5 | Presence | Non-Available | $A1B_2$ 80% or less, Cohesion | X |
| 135 | 470 | 5 | Presence | Non-Available | $A1B_2$ 80% or less, Cohesion | X |

TABLE 23

| | Casting | Chemical Composition (wt %) | | | | | | | | |
|---|---|---|---|---|---|---|---|---|---|---|
| No. | Method | B | Mn | Mg | Cu | Cr | Zr | Zn | Ti | Remarks |
| 136 | A | 0.9 | 1.5 | | | | | | | Example of the Present Invention |
| 137 | B | 0.9 | 1.5 | | | | | | | Example of Comparison |
| 138 | C | 0.9 | 1.5 | | | | | | | |
| 139 | X | 0.9 | 1.5 | | | | | | | |
| 140 | Y | 0.9 | 1.5 | | | | | | | Example of the Present Invention |
| 141 | Z | 0.9 | 1.5 | | | | | | | |
| 142 | A | 0.9 | 0.3 | 1.8 | 0.6 | | | | 0.3 | |
| 143 | A | 0.9 | 1.5 | | 0.4 | 0.4 | | 0.5 | | |

TABLE 23-continued

| | Casting | Chemical Composition (wt %) | | | | | | | | |
|---|---|---|---|---|---|---|---|---|---|---|
| No. | Method | B | Mn | Mg | Cu | Cr | Zr | Zn | Ti | Remarks |
| 144 | A | 0.9 | 1.5 | | 0.2 | 0.2 | 0.05 | | 0.03 | |
| 145 | A | 1.1 | 2.0 | 1.0 | | | 0.3 | | | |
| 146 | A | 0.4 | 0.2 | | | | | | | Example of Comparison |
| 147 | A | 1.6 | 2.1 | | | | | | | |
| 148 | A | 0.9 | 1.5 | 1.9 | | | | | | Example of Reference |
| 149 | A | 0.9 | 1.5 | | 0.7 | | | | | |
| 150 | | 0.9 | 1.5 | | | 0.5 | | | | |
| 151 | A | 0.9 | 1.5 | | | | 0.4 | | | |
| 152 | A | 0.9 | 1.5 | | | | | 0.6 | | |
| 153 | A | 0.9 | 1.5 | | | | | | 0.4 | |

TABLE 24

| No. | Strength (MPa) | Elongation (%) | Availability or Non-Availability of Recycling of Scrap | $A1B_2$ (%) | Availability or Non-Availability of Hot Rolling Workability | Total Evaluation |
|---|---|---|---|---|---|---|
| 136 | 150 | 11 | Available | 90 | Available | ○ |
| 137 | 150 | 7 | Non-Available | 70 | Non-Available | X |
| 138 | 150 | 6 | Non-Available | 60 | Non-Available | X |
| 139 | 150 | 3 | Available | 80 | Available | X (Gas is mixed) |
| 140 | 155 | 11 | Available | 85 | Available | ○ |
| 141 | 160 | 10 | Available | 80 | Available | ○ |
| 142 | 250 | 9 | Available | 90 | Available | ○ |
| 143 | 245 | 8 | Available | 80 | Available | ○ |
| 144 | 245 | 7 | Available | 80 | Available | ○ |
| 145 | 260 | 8 | Available | 80 | Available | ○ |
| 146 | 120 | 15 | Available | 90 | Available | X (Neutron Absorbing Capacity) |
| 147 | 150 | 5 | Available | 90 | Non-Available | X (Coarse Compound) |
| 148 | 170 | 4 | Available | 80 | Available | Δ |
| 149 | 170 | 5 | Available | 85 | Available | Δ |
| 150 | 170 | 6 | Available | 90 | Available | Δ |
| 151 | 170 | 6 | Available | 85 | Available | Δ |
| 152 | 170 | 4 | Available | 85 | Available | Δ |
| 153 | 170 | 5 | Available | 80 | Available | Δ |

TABLE 25

| No. | Casting Method | Chemical Composition (wt %) B | Mn | Mg | Cu | Cr | Zr | Zn | Ti | Remarks |
|---|---|---|---|---|---|---|---|---|---|---|
| 136 | A | 0.9 | 1.5 | | | | | | | Example of |
| 154 | D | 0.9 | 1.5 | | | | | | | the Present |
| | | | | | | | | | | Invention |
| 137 | B | 0.9 | 1.5 | | | | | | | Example of |
| 138 | C | 0.9 | 1.5 | | | | | | | Comparison |
| 139 | X | 0.9 | 1.5 | | | | | | | |
| 140 | Y | 0.9 | 1.5 | | | | | | | Example of |
| 141 | Z | 0.9 | 1.5 | | | | | | | the Present |
| 155 | A | 0.9 | 1.5 | | | 0.1 | 0.05 | | | Invention |
| 156 | D | 0.9 | 1.5 | | | 0.1 | 0.05 | | | |
| 157 | B | 0.9 | 1.5 | | | 0.1 | 0.05 | | | Example of |
| 158 | C | 0.9 | 1.5 | | | 0.1 | 0.05 | | | Comparison |
| 159 | A | 0.9 | 2.0 | 1.0 | 0.3 | | | 0.2 | 0.03 | Example of |
| 160 | D | 0.9 | 0.3 | 1.0 | 0.3 | | | 0.2 | 0.03 | the Present |
| | | | | | | | | | | Invention |
| 161 | B | 0.9 | 2.0 | 1.0 | 0.3 | | | 0.2 | 0.03 | Example of |
| 162 | C | 0.9 | 0.3 | 1.0 | 0.3 | | | 0.2 | 0.03 | Reference |

TABLE 26

| No. | Strength (MPa) | Elongation (%) | Segregation of Boron | Availability or Non-Availability of Recycling of Scrap | State of Boron Compound | Total Evaluation |
|---|---|---|---|---|---|---|
| 136 | 150 | 11 | None | Available | $A1B_2$ 80% or more No Cohesion | ○ |
| 154 | 150 | 12 | None | Available | $A1B_2$ 80% or more No Cohesion | ○ |
| 137 | 150 | 7 | Presence | Non-Available | $A1B_2$ 80% or less, Cohesion | X |
| 138 | 150 | 6 | Presence | Non-Available | $A1B_2$ 80% or less, Cohesion | X |
| 139 | 140 | 3 | None | Available | $A1B_2$ 80% or more, No Cohesion | X (Gas is mixed) |
| 140 | 155 | 11 | None | Available | $A1B_2$ 80% or more, No Cohesion | ○ |
| 141 | 160 | 10 | None | Available | $A1B_2$ 80% or more, No Cohesion | ○ |
| 155 | 240 | 9 | None | Available | $A1B_2$ 80% or more, No Cohesion | ○ |
| 156 | 240 | 8 | None | Available | $A1B_2$ 80% or more, No Cohesion | ○ |
| 157 | 240 | 5 | Presence | Non-Available | $A1B_2$ 80% or less, Cohesion | X |
| 158 | 240 | 6 | Presence | Non-Available | $A1B_2$ 80% or less, Cohesion | X |
| 159 | 260 | 10 | None | Available | $A1B_2$ 80% or more, No Cohesion | ○ |
| 160 | 170 | 9 | None | Available | $A1B_2$ 80% or more, No Cohesion | ○ |
| 161 | 260 | 4 | Presence | Non-Available | $A1B_2$ 80% or less, Cohesion | X |
| 162 | 170 | 4 | Presence | Non-Available | $A1B_2$ 80% or less, Cohesion | X |

TABLE 27

| No. | Casting Method | Chemical Composition (wt %) B | Fe | Si | Remarks |
|---|---|---|---|---|---|
| 163 | A | 0.9 | 0.4 | 0.7 | Example of the Present Invention |
| 164 | B | 0.9 | 0.4 | 0.7 | Example of Comparison |
| 165 | C | 0.9 | 0.4 | 0.7 | |

TABLE 27-continued

| No. | Casting Method | Chemical Composition (wt %) B | Fe | Si | Remarks |
|---|---|---|---|---|---|
| 166 | X | 0.9 | 0.4 | 0.7 | |
| 167 | Y | 0.9 | 0.4 | 0.7 | Example of the |
| 168 | Z | 0.9 | 0.4 | 0.7 | Present Invention |
| 169 | A | 1.1 | 0.4 | 0.7 | |

TABLE 27-continued

| No. | Casting Method | Chemical Composition (wt %) B | Fe | Si | Remarks |
|---|---|---|---|---|---|
| 170 | A | 0.9 | 0.1 | 0.1 | |
| 171 | A | 0.9 | 1.5 | 1.0 | |
| 172 | A | 0.9 | 2.0 | 1.5 | |
| 173 | A | 0.4 | 2.0 | 1.5 | Example of Comparison |
| 174 | A | 1.6 | 2.0 | 1.5 | |
| 175 | A | 0.9 | 1.0 | 1.6 | Example of Comparison |
| 176 | A | 0.9 | 2.1 | 0.7 | |

TABLE 28

| No. | Strength (MPa) | Elon-gation (%) | Availability or Non-Availability of Recycling of Scrap | $A1B_2$ (%) | Availability or Non-Availability of Hot Rolling Workability | Total Evaluation |
|---|---|---|---|---|---|---|
| 163 | 105 | 30 | Available | 90 | Available | ○ |
| 164 | 105 | 15 | Non-Available | 70 | Non-Available | X |
| 165 | 105 | 17 | Non-Available | 60 | Non-Available | X |
| 166 | 105 | 14 | Available | 80 | Available | X (Gas is mixed) |
| 167 | 100 | 32 | Available | 85 | Available | ○ |
| 168 | 98 | 36 | Available | 80 | Available | ○ |
| 169 | 102 | 33 | Available | 90 | Available | ○ |
| 170 | 105 | 35 | Available | 80 | Available | ○ |
| 171 | 110 | 31 | Available | 80 | Available | ○ |
| 172 | 112 | 33 | Available | 80 | Available | ○ |
| 173 | 102 | 19 | Available | 90 | Available | X (Neutron Absorbing Capacity) |
| 174 | 102 | 15 | Available | 90 | Non-Available | X (Coarse Compound) |
| 175 | 100 | 15 | Available | 80 | Non-Available | X (Coarse Compound) |
| 176 | 97 | 16 | Available | 85 | Non-Available | X (Coarse Compound) |

TABLE 29

| No. | Casting Method | Chemical Composition (wt %) B | Fe | Si | Remarks |
|---|---|---|---|---|---|
| 163 | A | 0.9 | 0.4 | 0.7 | Example of the Present Invention |
| 177 | D | 0.9 | 0.4 | 0.7 | |
| 164 | B | 0.9 | 0.4 | 0.7 | Example of Comparison |
| 165 | C | 0.9 | 0.4 | 0.7 | |
| 166 | X | 0.9 | 0.4 | 0.7 | |
| 167 | Y | 0.9 | 0.4 | 0.7 | Example of the Present |
| 168 | Z | 0.9 | 0.4 | 0.7 | Invention |
| 170 | A | 0.9 | 0.1 | 0.1 | Example of the Present |
| 178 | D | 0.9 | 2.0 | 1.5 | Invention |
| 179 | B | 0.9 | 0.1 | 0.1 | Example of Comparison |
| 180 | C | 0.9 | 2.0 | 1.5 | |

TABLE 30

| No. | Strength (MPa) | Elongation (%) | Segregation of Boron | Availability or Non-Availability of Recycling of Scrap | State of Boron Compound | Total Evaluation |
|---|---|---|---|---|---|---|
| 163 | 105 | 30 | None | Available | $A1B_2$ 80% or more No Cohesion | ○ |
| 177 | 108 | 33 | None | Available | $A1B_2$ 80% or more No Cohesion | ○ |
| 164 | 105 | 15 | Presence | Non-Available | $A1B_2$ 80% or less, Cohesion | X |
| 165 | 105 | 17 | Presence | Non-Available | $A1B_2$ 80% or less, Cohesion | X |
| 166 | 105 | 14 | None | Available | $A1B_2$ 80% or more, No Cohesion | X (Gas is mixed) |
| 167 | 100 | 32 | None | Available | $A1B_2$ 80% or more, No Cohesion | ○ |
| 168 | 98 | 36 | None | Available | $A1B_2$ 80% or more, No Cohesion | ○ |
| 170 | 105 | 35 | None | Available | $A1B_2$ 80% or more, No Cohesion | ○ |
| 178 | 108 | 37 | None | Available | $A1B_2$ 80% or more, No Cohesion | ○ |
| 179 | 103 | 18 | Presence | Non-Available | $A1B_2$ 80% or less, Cohesion | X |
| 180 | 101 | 15 | Presence | Non-Available | $A1B_2$ 80% or less, Cohesion | X |

TABLE 31

| | Casting | Chemical Composition (wt %) | | | | | | | | | | Pressure in the Furnace | |
|---|---|---|---|---|---|---|---|---|---|---|---|---|---|
| No. | Method | B | Mg | Zn | Fe | Si | Cu | Mn | Cr | Zr | Ti | (Torr) | Remarks |
| 181 | A | 0.9 | 2.5 | 6.0 | | | | | | | | 760 | Example of |
| 182 | A | 0.9 | 2.5 | 6.0 | | | | | | | | 600 | the Present |
| 183 | A | 0.9 | 2.5 | 6.0 | | | | | | | | 550 | Invention |
| 184 | A | 0.9 | 2.5 | 6.0 | | | | | | | | 500 | Example of |
| 185 | A | 0.9 | 2.5 | 6.0 | | | | | | | | 450 | the Present |
| 186 | A | 0.9 | 2.5 | 6.0 | | | | | | | | 300 | Invention |
| 187 | A | 0.9 | 2.5 | 6.0 | | | 1.5 | 1.0 | | | 0.03 | 300 | |
| 188 | A | 0.9 | 2.5 | 6.0 | | | | | 0.3 | 0.3 | | 300 | |
| 189 | A | 0.9 | 2.5 | 6.0 | 0.5 | 1.6 | 1.5 | 0.3 | 0.2 | 0.03 | 0.03 | 300 | |
| 190 | A | 0.4 | 2.5 | 6.0 | | | | | | | | 300 | Example of Comparison |
| 191 | A | 0.5 | 2.5 | 6.0 | | | | | | | | 300 | Example of the Present Invention |
| 192 | A | 1.6 | 2.5 | 6.0 | | | | | | | | 300 | Example of Comparison |

TABLE 32

| No. | Segregation of Boron | Hydrogen Concentration (ppm) | Surface State of Rolled Plate | Total Evaluation |
|---|---|---|---|---|
| 181 | ○ | 4.12 | X | Δ |
| 182 | ○ | 2.03 | X | Δ |
| 183 | ○ | 1.10 | X | Δ |
| 184 | ◎ | 0.52 | ◎ | ◎ |
| 185 | ◎ | 0.50 | ◎ | ◎ |
| 186 | ◎ | 0.48 | ◎ | ◎ |
| 187 | ◎ | 0.47 | ◎ | ◎ |
| 188 | ◎ | 0.46 | ◎ | ◎ |
| 189 | ◎ | 0.47 | ◎ | ◎ |

TABLE 32-continued

| No. | Segregation of Boron | Hydrogen Concentration (ppm) | Surface State of Rolled Plate | Total Evaluation |
|---|---|---|---|---|
| 190 | ◎ | 0.40 | ◎ | X |
| 191 | ◎ | 0.41 | ◎ | ○ |
| 192 | ◎ | 0.46 | ◎ | X |

TABLE 33

| No. | Casting Method | Chemical Composition (wt %) B | Cu | Fe | Si | Mg | Mn | Cr | Zr | Zn | Ti | Pressure in the Furnace (Torr) | Remarks |
|---|---|---|---|---|---|---|---|---|---|---|---|---|---|
| 193 | A | 0.9 | 4.5 | | | | | | | | | 760 | Example of |
| 194 | A | 0.9 | 4.5 | | | | | | | | | 600 | the Present |
| 195 | A | 0.9 | 4.5 | | | | | | | | | 550 | Invention |
| 196 | A | 0.9 | 4.5 | | | | | | | | | 500 | Example of |
| 197 | A | 0.9 | 4.5 | | | | | | | | | 450 | the Present |
| 198 | A | 0.9 | 4.5 | | | | | | | | | 300 | Invention |
| 199 | A | 0.9 | 4.5 | | | 1.5 | 0.3 | | | | 0.03 | 300 | |
| 200 | A | 0.9 | 4.5 | | | | | 0.1 | 0.05 | 0.5 | | 300 | |
| 201 | A | 0.9 | 4.5 | 0.5 | 0.5 | 1.2 | 0.7 | 0.1 | 0.03 | 0.25 | 0.03 | 300 | |
| 202 | A | 0.4 | 4.5 | | | | | | | | | 300 | Example of Comparison |
| 203 | A | 0.4 | 4.5 | | | | | | | | | 300 | Example of the Present Invention |
| 204 | A | 1.6 | 4.5 | | | | | | | | | 300 | Example of Comparison |

TABLE 34

| No. | Segregation of Boron | Hydrogen Concentration (ppm) | Surface State of Rolled Plate | Total Evaluation |
|---|---|---|---|---|
| 193 | ○ | 3.85 | X | Δ |
| 194 | ○ | 2.60 | X | Δ |
| 195 | ○ | 1.23 | X | ○ |
| 196 | ◎ | 0.52 | ◎ | ◎ |
| 197 | ◎ | 0.53 | ◎ | ◎ |
| 198 | ◎ | 0.45 | ◎ | ◎ |
| 199 | ◎ | 0.38 | ◎ | ◎ |
| 200 | ◎ | 0.40 | ◎ | ◎ |
| 201 | ◎ | 0.39 | ◎ | ◎ |
| 202 | ◎ | 0.45 | ◎ | X |
| 203 | ◎ | 0.42 | ◎ | ○ |
| 204 | ◎ | 0.43 | ◎ | X |

TABLE 35

| No. | Casting Method | Chemical Composition (wt %) B | Mn | Fe | Si | Mg | Cu | Cr | Zr | Zn | Ti | Pressure in the Furnace (Torr) | Remarks |
|---|---|---|---|---|---|---|---|---|---|---|---|---|---|
| 205 | A | 0.9 | 1.5 | | | | | | | | | 760 | Example of |
| 206 | A | 0.9 | 1.5 | | | | | | | | | 600 | the Present |
| 207 | A | 0.9 | 1.5 | | | | | | | | | 550 | Invention |
| 208 | A | 0.9 | 1.5 | | | | | | | | | 500 | Example of |
| 209 | A | 0.9 | 1.5 | | | | | | | | | 450 | the Present |
| 210 | A | 0.9 | 1.5 | | | | | | | | | 300 | Invention |
| 211 | A | 0.9 | 1.5 | | | 1.0 | 0.3 | | | 0.2 | 0.03 | 300 | |
| 212 | A | 0.9 | 1.5 | | | | | 0.1 | 0.05 | | | 300 | |
| 213 | A | 0.9 | 1.5 | 0.7 | 0.3 | 1.0 | 0.25 | — | 0.1 | 0.25 | 0.03 | 300 | |
| 214 | A | 0.4 | 1.5 | | | | | | | | | 300 | Example of Comparison |
| 215 | A | 0.5 | 1.5 | | | | | | | | | 300 | Example of the Present Invention |
| 216 | A | 1.6 | 1.5 | | | | | | | | | 300 | Example of Comparison |

TABLE 36

| No. | Segregation of Boron | Hydrogen Concentration (ppm) | Surface State of Rolled Plate | Total Evaluation |
|---|---|---|---|---|
| 205 | ○ | 3.95 | X | Δ |
| 206 | ○ | 2.10 | X | Δ |
| 207 | ○ | 0.90 | X | Δ |
| 208 | ◎ | 0.48 | ◎ | ◎ |
| 209 | ◎ | 0.55 | ◎ | ◎ |
| 210 | ◎ | 0.40 | ◎ | ◎ |
| 211 | ◎ | 0.37 | ◎ | ◎ |
| 212 | ◎ | 0.42 | ◎ | ◎ |
| 213 | ◎ | 0.39 | ◎ | ◎ |
| 214 | ◎ | 0.38 | ◎ | X |
| 215 | ◎ | 0.37 | ◎ | ○ |
| 216 | ◎ | 0.43 | ◎ | X |

TABLE 37

| | Casting | Chemical Composition (wt %) | | | Pressure in the Furnace | |
|---|---|---|---|---|---|---|
| No. | Method | B | Fe | Si | (Torr) | Remarks |
| 217 | A | 0.9 | 0.4 | 0.7 | 760 | Example of the Present Invention |
| 218 | A | 0.9 | 0.4 | 0.7 | 600 | Example of the Present Invention |
| 219 | A | 0.9 | 0.4 | 0.7 | 550 | |
| 220 | A | 0.9 | 0.4 | 0.7 | 500 | Example of the Present Invention |
| 221 | A | 0.9 | 0.4 | 0.7 | 450 | |
| 222 | A | 1.1 | 0.4 | 0.7 | 300 | |
| 223 | A | 0.9 | 0.1 | 0.1 | 300 | |
| 224 | A | 0.9 | 1.5 | 1.0 | 300 | |
| 225 | A | 0.9 | 2.0 | 1.5 | 300 | |
| 226 | A | 0.4 | 0.4 | 0.7 | 300 | Example of Comparison |
| 227 | A | 0.5 | 0.4 | 0.7 | 300 | Example of the Present Invention |
| 228 | A | 1.6 | 0.4 | 0.7 | 300 | Example of Comparison |

TABLE 38

| No. | Segregation of Boron | Hydrogen Concentration (ppm) | Surface State of Rolled Plate | Total Evaluation |
|---|---|---|---|---|
| 217 | ○ | 4.03 | X | Δ |
| 218 | ○ | 1.90 | X | Δ |
| 219 | ○ | 0.80 | X | Δ |
| 220 | ◎ | 0.52 | ◎ | ◎ |
| 221 | ◎ | 0.50 | ◎ | ◎ |
| 222 | ◎ | 0.47 | ◎ | ◎ |
| 223 | ◎ | 0.48 | ◎ | ◎ |
| 224 | ◎ | 0.38 | ◎ | ◎ |
| 225 | ◎ | 0.40 | ◎ | ◎ |
| 226 | ◎ | 0.39 | ◎ | X |
| 227 | ◎ | 0.42 | ◎ | ○ |
| 228 | ◎ | 0.45 | ◎ | X |

TABLE 39

| | Casting | Chemical Composition (wt %) | | | |
|---|---|---|---|---|---|
| No. | Method | B | Fe | Si | Remarks |
| 170 | A | 0.9 | 0.1 | 0.1 | Example of the Present Invention |
| 163 | A | 0.9 | 0.4 | 0.7 | |
| 171 | A | 0.9 | 1.5 | 1.0 | |
| 172 | A | 0.9 | 2.0 | 1.5 | |
| 175 | A | 0.9 | 1.0 | 1.6 | Example of Comparison |
| 176 | A | 0.9 | 2.0 | 0.7 | |
| 229 | A | 0.4 | 0.4 | 0.7 | |
| 230 | A | 1.6 | 0.4 | 0.7 | |

TABLE 40

| | Casting | Chemical Composition (wt %) | | | | | | | | | | |
|---|---|---|---|---|---|---|---|---|---|---|---|---|
| No. | Method | B | Fe | Si | Mg | Cu | Mn | Cr | Zr | Zn | Ti | Remarks |
| 231 | A | 0.9 | 0.4 | 0.1 | 4.0 | 0.5 | 0.1 | 0.1 | 0.05 | 0.3 | 0.03 | Example of the Present Invention |
| 232 | A | 0.9 | 2.1 | 0.1 | 4.0 | 0.5 | 0.1 | 0.1 | 0.05 | 0.3 | 0.03 | Example of |
| 233 | A | 0.9 | 0.4 | 1.6 | 4.0 | 0.5 | 0.1 | 0.1 | 0.05 | 0.3 | 0.03 | Comparison |

TABLE 41

| | Casting | Chemical Composition (wt %) | | | | | | | | | | |
|---|---|---|---|---|---|---|---|---|---|---|---|---|
| No. | Method | B | Fe | Si | Mg | Cu | Mn | Cr | Zr | Zn | Ti | Remarks |
| 234 | A | 0.9 | 0.4 | 0.7 | 1.0 | 0.6 | 1.0 | 0.3 | 0.05 | 0.3 | 0.3 | Example of the Present Invention |
| 235 | A | 0.9 | 2.1 | 0.7 | 1.0 | 0.6 | 1.0 | 0.3 | 0.05 | 0.3 | 0.3 | Example of |
| 236 | A | 0.9 | 0.4 | 1.6 | 1.0 | 0.6 | 1.0 | 0.3 | 0.05 | 0.3 | 0.3 | Comparison |

TABLE 42

| No. | Casting Method | Chemical Composition (wt %) B | Fe | Si | Mg | Cu | Mn | Cr | Zr | Zn | Ti | Remarks |
|---|---|---|---|---|---|---|---|---|---|---|---|---|
| 237 | A | 0.9 | 0.5 | 0.5 | 1.2 | 4.0 | 0.7 | 0.1 | 0.03 | 0.25 | 0.03 | Example of the Present Invention |
| 238 | A | 0.9 | 2.1 | 0.5 | 1.2 | 4.0 | 0.7 | 0.1 | 0.03 | 0.25 | 0.03 | Example of |
| 239 | A | 0.9 | 0.5 | 1.6 | 1.2 | 4.0 | 0.7 | 0.1 | 0.03 | 0.25 | 0.03 | Comparison |

TABLE 43

| No. | Casting Method | Chemical Composition (wt %) B | Fe | Si | Mg | Cu | Mn | Cr | Zr | Zn | Ti | Remarks |
|---|---|---|---|---|---|---|---|---|---|---|---|---|
| 240 | A | 0.9 | 0.7 | 0.3 | 1.0 | 0.25 | 1.2 | — | 0.1 | 0.25 | 0.03 | Example of the Present Invention |
| 241 | A | 0.9 | 2.1 | 0.3 | 1.0 | 0.25 | 1.2 | — | 0.1 | 0.25 | 0.03 | Example of |
| 242 | A | 0.9 | 0.7 | 1.6 | 1.0 | 0.25 | 1.2 | — | 0.1 | 0.25 | 0.03 | Comparison |

TABLE 44

| No. | Casting Method | Chemical Composition (wt %) B | Fe | Si | Mg | Cu | Mn | Cr | Zr | Zn | Ti | Remarks |
|---|---|---|---|---|---|---|---|---|---|---|---|---|
| 243 | A | 0.9 | 0.5 | 0.4 | 2.5 | 1.5 | 0.3 | 0.2 | 0.03 | 5.5 | 0.03 | Example of the Present Invention |
| 244 | A | 0.9 | 2.1 | 0.4 | 2.5 | 1.5 | 0.3 | 0.2 | 0.03 | 5.5 | 0.03 | Example of |
| 245 | A | 0.9 | 0.5 | 1.6 | 2.5 | 1.5 | 0.3 | 0.2 | 0.03 | 5.5 | 0.03 | Comparison |

TABLE 45

| No. | Strength (MPa) | Elon-gation (%) | Availability or Non-Availability of Recycling of Scrap | $A1B_2$ (%) | Availability or Non-Availability of Hot Rolling Workability | Total Evaluation |
|---|---|---|---|---|---|---|
| 170 | 105 | 35 | Available | 90 | Available | ○ |
| 163 | 105 | 30 | Available | 90 | Available | ○ |
| 171 | 110 | 31 | Available | 80 | Available | ○ |
| 172 | 112 | 33 | Available | 80 | Available | ○ |
| 175 | 100 | 15 | Available | 80 | Non-Available | X |
| 176 | 97 | 16 | Available | 85 | Non-Available | X |
| 229 | 110 | 14 | Available | 90 | Available | X (Neutron Absorbing Capacity) |
| 230 | 110 | 15 | Available | 80 | Non-Available | X (Coarse Compound) |

TABLE 46

| No. | Strength (MPa) | Elon-gation (%) | Availability or Non-Availability of Recycling of Scrap | $A1B_2$ (%) | Availability or Non-Availability of Hot Rolling Workability | Total Evalu-ation |
|---|---|---|---|---|---|---|
| 231 | 270 | 18 | Available | 80 | Available | ○ |
| 232 | 270 | 6 | Available | 85 | Non-Available | X |
| 233 | 270 | 8 | Available | 90 | Non-Available | X |

TABLE 47

| No. | Strength (MPa) | Elon-gation (%) | Availability or Non-Availability of Recycling of Scrap | $A1B_2$ (%) | Availability or Non-Availability of Hot Rolling Workability | Total Evalu-ation |
|---|---|---|---|---|---|---|
| 234 | 290 | 12 | Available | 80 | Available | ○ |
| 235 | 290 | 4 | Available | 85 | Non-Available | X |
| 236 | 290 | 3 | Available | 85 | Non-Available | X |

TABLE 48

| No. | Strength (MPa) | Elon-gation (%) | Availability or Non-Availability of Recycling of Scrap | $A1B_2$ (%) | Availability or Non-Availability of Hot Rolling Workability | Total Evalu-ation |
|---|---|---|---|---|---|---|
| 237 | 480 | 10 | Available | 90 | Available | ○ |
| 238 | 480 | 6 | Available | 80 | Non-Available | X |
| 239 | 475 | 7 | Available | 85 | Non-Available | X |

TABLE 49

| No. | Strength (MPa) | Elon-gation (%) | Availability or Non-Availability of Recycling of Scrap | $A1B_2$ (%) | Availability or Non-Availability of Hot Rolling Workability | Total Evalu-ation |
|---|---|---|---|---|---|---|
| 240 | 250 | 9 | Available | 90 | Available | ○ |
| 241 | 250 | 4 | Available | 85 | Non-Available | X |
| 242 | 245 | 3 | Available | 80 | Non-Available | X |

TABLE 50

| No. | Strength (MPa) | Elon-gation (%) | Availability or Non-Availability of Recycling of Scrap | $A1B_2$ (%) | Availability or Non-Availability of Hot Rolling Workability | Total Evalu-ation |
|---|---|---|---|---|---|---|
| 243 | 525 | 9 | Available | 80 | Available | ○ |
| 244 | 525 | 6 | Available | 85 | Non-Available | X |
| 245 | 525 | 5 | Available | 85 | Non-Available | X |

What is claimed is:

1. An Al alloy, consisting essentially of:

0.5 to 1.5 wt. % B, with the balance Al and inevitable impurities, wherein said boron has an isotopic ratio $^{10}B/(^{10}B+^{11}B)\geqq 95\%$, and a ratio of $AlB_2$ to all boron compounds in said alloy is 80% or more by volume.

2. The Al alloy of claim 1, further comprising 2 to 8 wt. % Mg.

3. The Al alloy of claim 2, further comprising at least one element selected from the group consisting of 0.6 wt. % or less Cu, 1.0 wt. % or less Mn, 0.4 wt. % or less Cr, 0.3 wt. % or less Zr, 0.5 wt. % or less Zn, and 0.3 wt. % or less Ti.

4. The Al alloy of claim 1, further comprising 0.3 to 1.5 wt. % Mg, and 0.3 to 1.5 wt. % Si.

5. The Al alloy of claim 4, further comprising at least one element selected from the group consisting of 0.6 wt. % or less Cu, 1.0 wt. % or less Mn, 0.4 wt. % or less Cr, 0.3 wt. % or less Zr, 0.5 wt. % or less Zn, and 0.3 wt. % or less Ti.

6. The Al alloy of claim 1, further comprising 1.0 to 4.0 wt. % Mg, and 0.8 to 8.0 wt. % Zn.

7. The Al alloy of claim 6, further comprising at least one element selected from the group consisting of 3.0 wt. % or less Cu, 1.0 wt. % or less Mn, 0.4 wt. % or less Cr, 0.3 wt. % or less Zr, and 0.3 wt. % or less Ti.

8. The Al alloy of claim 1, further comprising 1.5 to 7.0 wt. % Cu.

9. The Al alloy of claim 8, further comprising at least one element selected from the group consisting of 1.8 wt. % or less Mg, 1.2 wt. % or less Mn, 0.4 wt. % or less Cr, 0.3 wt. % or less Zr, 0.5 wt. % or less Zn, and 0.3 wt. % or less Ti.

10. The Al alloy of claim 1, further comprising 0.3 to 2.0 wt. % Mn.

11. The Al alloy of claim 10, further comprising at least one element selected from the group consisting of 1.8 wt. % or less Mg, 0.6 wt. % or less Cu, 0.4 wt. % or less Cr, 0.3 wt. % or less Zr, 0.5 wt. % or less Zn, and 0.3 wt. % or less Ti.

12. The Al alloy of any one of claims 1, 2, 3, 6, 7, 8, 9, 10, 11, further comprising 2.0 wt. % or less Fe, and 1.5 wt. % or less Si.

13. The Al alloy of claim 4 or 5, further comprising 2.0 wt. % or less Fe.

14. The Al alloy of claim 1, wherein a residual concentration of hydrogen is 0.6 ppm or less.

15. The Al alloy of claim 3, wherein a residual concentration of hydrogen is 0.6 ppm or less.

* * * * *